US007677182B2

(12) United States Patent
Mueller et al.

(10) Patent No.: US 7,677,182 B2
(45) Date of Patent: Mar. 16, 2010

(54) TWO PERSON WORK ENVIRONMENT

(75) Inventors: Karl H. Mueller, East Grand Rapids, MI (US); David K. Jones, Grand Rapids, MI (US); James N. Ludwig, East Grand Rapids, MI (US); Brett R. Kincaid, Lowell, MI (US); John R. Hamilton, Grand Rapids, MI (US); Colin L. Nourie, Cincannati, OH (US)

(73) Assignee: Steelcase Development Corporation, Grand Rapids, MI (US)

( * ) Notice: Subject to any disclaimer, the term of this patent is extended or adjusted under 35 U.S.C. 154(b) by 610 days.

(21) Appl. No.: 11/138,790

(22) Filed: May 25, 2005

(65) Prior Publication Data

US 2005/0268825 A1 Dec. 8, 2005

Related U.S. Application Data

(60) Provisional application No. 60/574,806, filed on May 27, 2004.

(51) Int. Cl.
*A47B 37/00* (2006.01)

(52) U.S. Cl. ..... 108/50.01; 52/36.1; 108/60

(58) Field of Classification Search ..... 108/50.01, 108/50.02, 42; 52/36.1, 36.5, 79.1, 239, 52/282.2, 238.1, 220.7, 36.4; 160/130, 135, 160/136

See application file for complete search history.

(56) References Cited

U.S. PATENT DOCUMENTS

| | | | |
|---|---|---|---|
| 158,217 | A | 12/1874 | Low |
| 358,626 | A | 3/1887 | Robinson |
| 792,040 | A | 6/1905 | Hopkins |
| 794,809 | A | 7/1905 | Marsh |
| 892,612 | A | 7/1908 | O'Neill |
| 995,410 | A | 6/1911 | McClure |
| 1,328,918 | A | 1/1920 | Fulda |
| 1,424,531 | A | 8/1922 | Turbeville |

(Continued)

FOREIGN PATENT DOCUMENTS

| | | |
|---|---|---|
| DE | 30 03 017 | 1/1980 |

(Continued)

*Primary Examiner*—José V Chen
(74) *Attorney, Agent, or Firm*—Quarles & Brady LLP

(57) ABSTRACT

A work space assembly for use by a pair of people where the pair of people include first and second persons, the system providing each of the first and second persons with a private space and also providing a shared space to be shared by the pair of people during collaboration, the assembly comprising an enclosure wall having first and second distal wall edges that are within an opening plane, the enclosure wall forming a station space including one open side between the distal edges, a rear portion of the enclosure wall spaced a station depth from the opening plane, the enclosure wall having an enclosure height of at least forty-eight inches, divider components including a table top having a table top length dimension between first and second oppositely facing ends and a table height of between 44 and 55 inches and wherein, divider components are positioned with the table top length dimension substantially perpendicular to the rear portion of the enclosure wall and extending therefrom toward the opening plane, the divider components together partitioning the station space into first and second subspaces.

41 Claims, 24 Drawing Sheets

U.S. PATENT DOCUMENTS

| | | | |
|---|---|---|---|
| 1,706,388 | A | 3/1929 | Ashkenas |
| 1,820,123 | A | 8/1931 | Donavan |
| 1,952,749 | A | 3/1934 | Ellis |
| 2,182,703 | A | 12/1939 | Rainwater |
| 2,214,204 | A | 9/1940 | Pollard |
| D127,928 | S | 6/1941 | Wellmam |
| D172,098 | S | 5/1954 | Knoll |
| 2,734,952 | A | 2/1956 | Austin |
| 2,894,576 | A | 7/1959 | Williams |
| 2,942,924 | A | 6/1960 | Stangert |
| 2,981,583 | A | 4/1961 | Eisenberg |
| 3,017,969 | A | 1/1962 | Nielsen |
| 3,027,214 | A | 3/1962 | Curatolo |
| 3,065,334 | A | 11/1962 | Hillenbrand et al. |
| 3,147,336 | A | 9/1964 | Matthews |
| 3,312,025 | A | 4/1967 | Deakins |
| 3,399,856 | A | 9/1968 | Pecaut |
| 3,463,218 | A | 8/1969 | Cannon et al. |
| 3,559,942 | A | 2/1971 | Lucasey |
| 3,592,288 | A | 7/1971 | Walter |
| 3,705,468 | A | 12/1972 | Ashworth |
| 3,713,474 | A | 1/1973 | Orlando |
| 3,729,627 | A | 4/1973 | Littell |
| 3,762,051 | A | 10/1973 | Valeska |
| 3,802,146 | A | 4/1974 | Tacke et al. |
| 3,807,826 | A | 4/1974 | Peckenpaugh |
| 3,817,396 | A | 6/1974 | Markson |
| 3,871,435 | A | 3/1975 | Lopatka |
| 3,904,866 | A | 9/1975 | Haves |
| 3,927,924 | A | 12/1975 | Kelley |
| D239,061 | S | 3/1976 | D'Elia |
| 3,955,788 | A | 5/1976 | Delage |
| D242,832 | S | 12/1976 | Swensson |
| D243,051 | S | 1/1977 | Goulooze |
| 4,068,700 | A | 1/1978 | Legler |
| 4,090,335 | A | 5/1978 | Curatolo |
| 4,120,124 | A | 10/1978 | Temple et al. |
| 4,121,645 | A | 10/1978 | Behr |
| 4,145,097 | A | 3/1979 | Naess et al. |
| 4,175,154 | A | 11/1979 | Faust et al. |
| 4,177,612 | A | 12/1979 | Tochihara |
| 4,219,101 | A | 8/1980 | Valsvik |
| 4,241,777 | A | 12/1980 | Wenger et al. |
| 4,265,502 | A | 5/1981 | Blodee et al. |
| 4,305,563 | A | 12/1981 | Presson |
| 4,306,655 | A | 12/1981 | Smith |
| 4,325,204 | A | 4/1982 | Martine |
| 4,336,670 | A | 6/1982 | Brutosky |
| 4,365,561 | A | 12/1982 | Tellier et al. |
| 4,372,087 | A | 2/1983 | Kump |
| 4,382,642 | A | 5/1983 | Burdick |
| 4,423,573 | A | 1/1984 | Omholt et al. |
| 4,433,884 | A | 2/1984 | Edwards et al. |
| 4,450,658 | A | 5/1984 | Legeai |
| D278,820 | S | 5/1985 | Woodhall |
| 4,516,620 | A | 5/1985 | Mulhern |
| 4,516,751 | A | 5/1985 | Westbrook |
| 4,561,619 | A | 12/1985 | Robillard et al. |
| 4,562,987 | A | 1/1986 | Leeds et al. |
| 4,612,863 | A | 9/1986 | Vonhausen et al. |
| 4,619,427 | A | 10/1986 | Leymann |
| 4,624,083 | A | 11/1986 | Diffrient |
| 4,637,666 | A | 1/1987 | Worrell et al. |
| 4,659,048 | A | 4/1987 | Fahrion |
| 4,715,154 | A | 12/1987 | Baloga |
| 4,732,089 | A | 3/1988 | Müeller |
| 4,733,618 | A | 3/1988 | Sarro et al. |
| 4,807,539 | A | 2/1989 | Del Castillo von Haucke |
| 4,817,903 | A | 4/1989 | Braehler et al. |
| 4,821,477 | A | 4/1989 | Rydqvist |
| 4,836,478 | A | 6/1989 | Sweere |
| 4,852,500 | A | 8/1989 | Ryburg et al. |
| 4,914,873 | A | 4/1990 | Newhouse |
| 4,932,172 | A | 6/1990 | Maas |
| 4,932,177 | A | 6/1990 | Hinden |
| 4,949,490 | A | 8/1990 | Miller |
| 4,986,505 | A | 1/1991 | Zabawski et al. |
| 5,000,210 | A | 3/1991 | Worthington, Jr. |
| 5,007,608 | A | 4/1991 | Carroll, Jr. |
| 5,016,405 | A | 5/1991 | Lee |
| 5,041,770 | A | 8/1991 | Seiler et al. |
| D320,129 | S | 9/1991 | Perrego et al. |
| 5,065,832 | A | 11/1991 | Mark |
| 5,069,011 | A | 12/1991 | Jenne |
| 5,116,011 | A | 5/1992 | Smith |
| 5,125,202 | A | 6/1992 | Kissinger |
| D331,672 | S | 12/1992 | Brodbeck |
| D332,188 | S | 1/1993 | Brodbeck |
| D332,189 | S | 1/1993 | Brodbeck |
| 5,207,041 | A | 5/1993 | Wills |
| 5,214,885 | A | 6/1993 | Maas et al. |
| D340,235 | S | 10/1993 | Robak et al. |
| 5,282,341 | A | 2/1994 | Baloga et al. |
| 5,287,666 | A | 2/1994 | Frascaroli et al. |
| 5,287,909 | A | 2/1994 | King et al. |
| 5,309,686 | A | 5/1994 | Underwood et al. |
| 5,321,579 | A | 6/1994 | Brown et al. |
| 5,322,473 | A | 6/1994 | Hofstra et al. |
| 5,392,934 | A | 2/1995 | Fox |
| 5,403,232 | A | 4/1995 | Helm et al. |
| 5,405,117 | A | 4/1995 | Davis |
| D366,165 | S | 1/1996 | Holsinger et al. |
| 5,486,042 | A | 1/1996 | Heisler et al. |
| 5,486,391 | A | 1/1996 | Tyner |
| 5,490,357 | A | 2/1996 | Lin |
| 5,543,204 | A | 8/1996 | Ray |
| 5,609,112 | A | 3/1997 | Meyer et al. |
| 5,651,219 | A | 7/1997 | Baloga et al. |
| 5,673,632 | A | 10/1997 | Sykes |
| 5,675,946 | A | 10/1997 | Verbeek et al. |
| 5,680,820 | A | 10/1997 | Randolph |
| 5,683,064 | A | 11/1997 | Copeland et al. |
| 5,724,778 | A | 3/1998 | Cornell et al. |
| D395,365 | S | 6/1998 | Verbeek et al. |
| D395,677 | S | 6/1998 | Gongora et al. |
| D396,572 | S | 8/1998 | Gongora et al. |
| D399,063 | S | 10/1998 | Verbeek et al. |
| 5,822,935 | A | 10/1998 | Mitchell et al. |
| 5,826,846 | A | 10/1998 | Buccieri et al. |
| D400,361 | S | 11/1998 | Sobrito |
| D400,376 | S | 11/1998 | Hallenheim |
| 5,829,202 | A | 11/1998 | Gongora et al. |
| D402,476 | S | 12/1998 | Thorp et al. |
| 5,848,497 | A | 12/1998 | Henderson |
| 5,848,798 | A | 12/1998 | Halvorson, Jr. et al. |
| D403,870 | S | 1/1999 | Gongora et al. |
| 5,873,205 | A | 2/1999 | Hanlon et al. |
| 5,875,597 | A | 3/1999 | Gingrich et al. |
| 5,877,896 | A | 3/1999 | Gremban |
| 5,893,616 | A | 4/1999 | MacDonald et al. |
| 5,904,328 | A | 5/1999 | Leveridge et al. |
| 5,908,002 | A | 6/1999 | Alexander et al. |
| 5,966,879 | A | 10/1999 | Verbeek et al. |
| 5,970,662 | A | 10/1999 | Corcorran et al. |
| D415,901 | S | 11/1999 | Arko et al. |
| 5,974,985 | A | 11/1999 | Flototto et al. |
| 5,979,118 | A | 11/1999 | Gortsema et al. |
| 6,012,504 | A | 1/2000 | Siegal |
| 6,018,915 | A | 2/2000 | Pomish et al. |
| D421,533 | S | 3/2000 | Lininger, Jr. et al. |
| D422,429 | S | 4/2000 | Belka et al. |
| D422,796 | S | 4/2000 | Milligan et al. |
| D423,828 | S | 5/2000 | Wilkinson |
| 6,058,655 | A | 5/2000 | Gravel |

| | | | | |
|---|---|---|---|---|
| 6,067,762 | A * | 5/2000 | Greer et al. | 52/239 |
| 6,076,473 | A | 6/2000 | Conte | |
| 6,076,474 | A | 6/2000 | Grabowski et al. | |
| D427,783 | S | 7/2000 | Luedke | |
| D427,784 | S | 7/2000 | Domina et al. | |
| 6,099,093 | A | 8/2000 | Spence | |
| 6,102,355 | A | 8/2000 | Rood | |
| 6,116,326 | A | 9/2000 | Domina et al. | |
| 6,128,873 | A * | 10/2000 | Shipman et al. | 52/220.7 |
| 6,128,877 | A | 10/2000 | Goodman et al. | |
| 6,134,103 | A | 10/2000 | Ghanma | |
| RE36,978 | E | 12/2000 | Moscovitch | |
| 6,158,178 | A | 12/2000 | Jeffers et al. | |
| 6,158,179 | A | 12/2000 | Ackerly et al. | |
| 6,173,933 | B1 | 1/2001 | Whiteside et al. | |
| 6,196,352 | B1 | 3/2001 | Goodchild | |
| 6,206,079 | B1 | 3/2001 | Selgrad | |
| 6,209,273 | B1 | 4/2001 | Jeffers et al. | |
| 6,213,191 | B1 | 4/2001 | Nitzsche | |
| 6,216,398 | B1 | 4/2001 | Shipman et al. | |
| 6,250,016 | B1 | 6/2001 | Gravel | |
| D446,659 | S | 8/2001 | Ludwig et al. | |
| 6,273,383 | B1 | 8/2001 | Oddsen, Jr. | |
| 6,286,275 | B1 | 9/2001 | Edwards | |
| D449,169 | S | 10/2001 | Bennie et al. | |
| D449,748 | S | 10/2001 | Martin et al. | |
| D450,465 | S | 11/2001 | Overthun et al. | |
| D456,182 | S | 4/2002 | Hamilton et al. | |
| 6,363,663 | B1 | 4/2002 | Kane et al. | |
| D457,017 | S | 5/2002 | Müller | |
| D457,359 | S | 5/2002 | Chan | |
| D458,040 | S | 6/2002 | Stannis et al. | |
| 6,409,134 | B1 | 6/2002 | Oddsen, Jr. | |
| D460,274 | S | 7/2002 | Bennie et al. | |
| D460,630 | S | 7/2002 | Ritch et al. | |
| 6,415,553 | B1 | 7/2002 | Krayer, Jr. et al. | |
| 6,435,523 | B1 | 8/2002 | Steeves et al. | |
| 6,446,751 | B1 | 9/2002 | Ahuja et al. | |
| 6,449,909 | B1 | 9/2002 | Baloga et al. | |
| 6,453,826 | B1 | 9/2002 | Fookes et al. | |
| 6,463,701 | B1 | 10/2002 | Baloga et al. | |
| 6,478,274 | B1 | 11/2002 | Oddsen, Jr. | |
| 6,505,988 | B1 | 1/2003 | Oddsen, Jr. | |
| 6,516,571 | B1 | 2/2003 | Overthun et al. | |
| 6,536,858 | B1 | 3/2003 | Heidmann et al. | |
| 6,554,238 | B1 | 4/2003 | Hibberd | |
| 6,568,335 | B2 | 5/2003 | Hamilton et al. | |
| 6,568,836 | B2 | 5/2003 | Wahl | |
| 6,594,963 | B1 | 7/2003 | Bennett | |
| 6,609,465 | B2 | 8/2003 | Kolavo | |
| 6,609,691 | B2 | 8/2003 | Oddsen, Jr. | |
| 6,615,747 | B2 | 9/2003 | Stenftenagel et al. | |
| 6,619,606 | B2 | 9/2003 | Oddsen, Jr. et al. | |
| 6,622,771 | B2 | 9/2003 | Plockmeyer | |
| 6,625,935 | B1 | 9/2003 | King et al. | |
| D481,886 | S | 11/2003 | Fahnstrom et al. | |
| 6,647,652 | B1 | 11/2003 | Seiber et al. | |
| 6,662,732 | B2 | 12/2003 | Birsel et al. | |
| 6,681,529 | B1 | 1/2004 | Baloga et al. | |
| 6,695,270 | B1 | 2/2004 | Smed | |
| 2001/0023914 | A1 | 9/2001 | Oddsen, Jr. | |
| 2002/0040667 | A1 | 4/2002 | Birsel et al. | |
| 2002/0040668 | A1 | 4/2002 | Chan et al. | |
| 2002/0043352 | A1 | 4/2002 | Stannis et al. | |
| 2002/0062933 | A1 | 5/2002 | Insalaco et al. | |
| 2002/0148936 | A1 | 10/2002 | Oddsen, Jr. | |
| 2002/0194791 | A1 | 12/2002 | Baloga et al. | |
| 2002/0194792 | A1 | 12/2002 | Feldausch et al. | |
| 2003/0051832 | A1 | 3/2003 | Plockmeyer | |
| 2003/0067256 | A1 | 4/2003 | Stenftenagel et al. | |
| 2003/0075654 | A1 | 4/2003 | Oddsen, Jr. | |
| 2003/0075655 | A1 | 4/2003 | Oddsen, Jr. | |
| 2003/0080268 | A1 | 5/2003 | Oddsen, Jr. | |
| 2003/0080269 | A1 | 5/2003 | Oddsen, Jr. | |
| 2003/0085328 | A1 | 5/2003 | Oddsen, Jr. | |
| 2003/0116687 | A1 | 6/2003 | Oddsen, Jr. | |
| 2003/0182871 | A1 | 10/2003 | Gresham et al. | |
| 2003/0234328 | A1 | 12/2003 | Oddsen, Jr. | |
| 2004/0004170 | A1 | 1/2004 | Oddsen, Jr. | |
| 2004/0011938 | A1 | 1/2004 | Oddsen, Jr. | |
| 2004/0014349 | A1 | 1/2004 | Oddsen, Jr. | |
| 2004/0031893 | A1 | 2/2004 | Smed | |

FOREIGN PATENT DOCUMENTS

| | | |
|---|---|---|
| DE | 30 37 679 | 5/1982 |
| DE | 32 39 371 | 4/1984 |
| DE | 42 20 178 | 12/1993 |
| EP | 0 145 018 | 6/1985 |
| EP | 0 145 410 | 6/1985 |
| EP | 0 256 160 | 2/1988 |
| EP | 0 447 961 | 9/1991 |
| EP | 0 670 125 | 9/1995 |
| JP | 05156731 | 12/1991 |
| JP | 2000157353 | 11/1998 |
| WO | WO 95/32644 | 5/1995 |
| WO | WO 98/04790 | 2/1998 |
| WO | WO 02/100213 | 6/2002 |
| WO | WO 02/100213 | 12/2002 |
| WO | WO 2004/022458 | 3/2004 |

* cited by examiner

TWO PERSON WORK ENVIRONMENT

CROSS-REFERENCE TO RELATED APPLICATIONS

This application is based on U.S. Provisional Patent Application Ser. No. 60/574,806 filed on May 27, 2004, and entitled "TWO PERSON WORK ENVIRONMENT".

STATEMENT REGARDING FEDERALLY SPONSORED RESEARCH OR DEVELOPMENT

Not applicable.

BACKGROUND OF THE INVENTION

The field of the invention is work space divider systems and more specifically partition systems that divide space into sub-spaces that are useable by two people to facilitate collaborative activity wherein the sub-spaces also include locations for private and more public activity.

Office designers have known for a long time that collaborative activity is extremely important to facilitate innovation and creative thinking—as the saying goes, two heads are better than one. In this regard, when groups of people interact as a team and share ideas, one person's ideas often act as a catalyst for the other team member's ideas and vice versa, such that final combined work products are far superior to the work product that a single person could muster in seclusion. For instance, when working on a new ad campaign, an exemplary team of five diverse people may feed off each others ideas and tentatively decide on a campaign theme and various general aspects of the campaign by drawing on each others experiences.

Despite the advantages of collaborative work, office designers also know that there are times when people need and appreciate at least some degree of privacy and personal space in order to perform certain employment and personal tasks. Thus, for instance, after the exemplary five person advertising team decides on a campaign theme and some general campaign details, the team assign different aspects of the campaign to different team members for further development. Here, to help members focus on the aspects that they are responsible for, each person on the team may want a private or at least semiprivate space to help physically block out distractions and protect ideas as they are developed.

As another instance, even while at work, many people perform at least some personal business from time to time such as paying bills, corresponding with friends via e-mail, booking vacations, searching for information on the Internet, eating lunch, reading the newspaper or a magazine, etc. Often people feel more secure tending to personal tasks if they are in an environment that provides at least some level of privacy.

In many cases people use computers to attend to personal business, to organize their thoughts and to test out new thoughts and ideas by expressing those ideas on a display screen. Thus, in many cases, required privacy simply amounts to a space wherein the only person that can readily view a display screen unimpeded is the person using the associated computer.

Knowing that both collaboration and privacy are important in office design and being constrained by overall office space, office designers are now developing office spaces that foster collaborative activities while still offering at least some level of privacy when desired. To this end, many offices now include open office plans wherein large office spaces are divided into smaller, generally standard sized, individual workspaces by partition walls that extend from a floor surface to a height (e.g., between 60 and 72 inches) that impedes a standing person of ordinary height from peering over from one side to the other. Hereinafter the typical height of a wall that impedes a standing person of ordinary height from peering over will be referred to as a "full height" wall unless indicated otherwise.

The full height walls provide at least some privacy for a person within a workspace but still allows the person to at least verbally communicate over the top thereof with a person in an adjacent workspace thereby facilitating at least some degree of collaboration. In addition, in the case of many partition systems, the access openings into the separate workspaces are left open thereby further facilitating interaction among persons that share a general area within the larger office space.

To provide support for office equipment and a work surface for writing, spreading out documents, etc., most workspaces include desk height credenzas (e.g., 24-32 inches) along the partition walls that provide top surfaces comfortably useable by a person sitting in a chair adjacent one of the credenzas. To provide the most work surface possible within a workspace, most systems include credenzas along each wall that separates one workspace from an adjacent workspace. Here, one or more "private" spaces within a standard sized workspace usually exist where a computer display screen is positionable such that views of the screen from outside the workspace are at least impeded.

In at least some cases partition systems have been designed with "partial height walls" (e.g., 42 inches) between adjacent workspaces so that persons in adjacent workspaces can make eye contact when at least one of the persons is standing but that still impedes a person that is sitting in one workspace from peering into the other workspace. Here, where first and second people are sitting in adjacent workspaces, neither of the people can see what the other person is doing but, for instance, when the first person wants to collaborate with the second person, the first person can just stand up to make eye contact with the second person. Where people can view each other while communicating, visual cues (e.g., facial expressions, posture, etc.) enhance communication effectiveness and hence collaboration.

Another office design technique that facilitates collaboration is to provide common areas or conference rooms for teams of people that include comfortable furniture, writing surfaces and collaborative tools such as display screens, writing boards, conferencing equipment, etc. Often open offices will include collaborative spaces interspersed throughout so that persons within the vicinity thereof have easy access thereto.

Yet another office design technique that has been used to foster communication is to provide a horizontal "standing height" surface (e.g., 42 inches) along the top of a partition wall in a reception area so that a person that approaches a receptionist located within the workspace is provided with a comfortable surface on which to place documents, to use as a writing surface, etc., while communicating with the receptionist. Here, a credenza or the like having a height lower than the height of the counter surface is typically provided on the workspace side of the counter surface and a display screen and keyboard are positioned on the credenza with the rear surface of the screen facing the standing height surface for use by a sitting or standing receptionist. Thus, the receptionist and a visitor have their own separate surfaces on which to perform tasks and the receptionist's display screen is hidden from viewing by a visitor located adjacent the standing height surface.

Still one other collaborative configurations include a desk height surface (e.g., 24-32 inches) either between adjacent workspaces or along an outer wall of a workspace that is common with a public space (e.g., a walkway between workspaces). Here, persons in adjacent workspaces or first and second persons in a workspace and in a public space, respectively, can collaborate around the desk surface while seated. In some cases desk surfaces positioned to facilitate collaboration include at least one rounded edge so that several persons can collaborate thereat.

While each of the configurations and design techniques described above has several advantages, unfortunately each of the configurations and techniques suffer form one or more shortcomings. First, it has been recognized that while two heads may be better than one, in fact, two heads may also be better than three, four or more heads, when it comes to collaborative activities. In this regard, it has been observed that whenever three or more persons collaborate on a project, usually a sub-set of the collaborators that are relatively more extroverted will lead the project and more freely share their ideas while the more introverted collaborators will simply follow the lead without making their ideas known. However, if one of the more introverted collaborators is paired with just one other person to collaborate on the same project, it has been observed that the introvert much more freely. Because most people communicate relatively freely in pairs we can assume that most people want to express their ideas.

While it is unclear why some persons tend to communicate more freely in pairs than in larger groups, it is believed that some people are relatively uncomfortable testing new ideas with other people in groups where a majority viewpoint is possible and likely. Here, for example, on one hand, where three people collaborate and two opinions are expressed, more often than not at least two people will share one opinion resulting in a majority. On the other hand, when two people collaborate, no majority is possible when a difference of opinion occurs—the worst that can happen is that the two people disagree. When faced with the possibility of simple disagreement people tend to express their ideas more freely than when faced with potentially having come up with, and having to defend, a minority position.

In addition, some people are relatively uncomfortable testing new ideas with other people in groups where it is difficult to obtain visual feedback. To this end it has been recognized that, because a person can only closely observe one other person at a time, a person can more readily perceive visual queues from one person than from people in larger groups during communication. For this reason, a person can gauge how test ideas are being perceived more readily in a pair than they can in larger groups. Where an idea is expressed and visual queues indicate a misunderstanding or clear disagreement, the ideas can be re-articulated or speedily dropped to avoid embarrassment.

Moreover, it is believed that, in general, people are more critical of ideas when in a group including three or more people than when working with only one other person. In this regard, people that have the same view point tend to feed off each others ideas and take comfort in the fact that their opinion is validated by someone else. When a person believes that her opinion has been validated by others, that person tends to become more critical of other opinions which adversely affects the collaborative process.

While some of the configurations and techniques described above can be used to facilitate communication between two people, none of the configurations or techniques is optimal. To this end, an optimal space for two person collaboration should include a space that is physically separate from a larger office space and is at least somewhat private for use by the two people, that includes a shared space or common work surface that is readily available for spontaneous use and where shared information can be maintained for long periods (e.g., several days or weeks), where the two people can, when desired, see each other during communication and where each of the two people has at least some private space for attending to personal or non-collaborative tasks. In addition, it would be advantageous if the space characteristics described above could be accomplished in a space that is similar to the space required to provide two standard sized workstations using existing partition systems so that additional office space would not be required.

Where full height (e.g., 60-72 inches) partition walls separate adjacent workspaces, communication between people in adjacent workspaces is difficult at best because the partition walls typically muffle sound to some extent and visual queues may be completely blocked. In addition, where people attempt to communicate over a full height wall confidentiality is usually lost as other people in the vicinity of the wall can usually hear any conversation. Moreover, full height wall configurations do not provide a common work surface that is readily available for spontaneous collaboration and where shared information can be maintained for long periods.

While conference rooms can be used by two people to confidentially collaborate and usually include a table that can be used as a common surface, conference rooms are usually reserved on a relatively formal basis which is not conducive to spontaneous collaborative activity. In addition, typically conference rooms are used for relatively small periods of time (e.g., a few hours) at the end of which shared information has to be removed. Whenever information has to be removed form a space continuity of thought is broken and overall creativity often suffers. Moreover, permanent conference rooms are costly, especially when not in use and are usually designed for use by more than two people so that when a pair of people are using a conference room the space is usually underutilized.

Where partition wall heights are reduced to partial height (e.g., a standing height), while a first person standing on one side of the wall can have a line of sight to and can communicate with a second person either standing or sitting on the other side of the wall, where a credenza or desk surface is located on one or both sides of the wall the first and second people are usually separated by several feet (e.g., the combined credenza widths). Here, as in the case of the full height walls, because of the space that separates the first and second people, communication over the credenzas and wall does not feel confidential and free/unencumbered collaboration tends to be minimal at best. In addition, partial height walls alone do not provide a surface on which two people can share ideas and on which information can be maintained for long periods.

Similarly, where a standing height surface is provided over a receptionist's desk as part of a receptionist workspace configuration or is provided over credenzas on either side of a partial height wall, a first person on one side of the standing height surface is separated from a second person on the other side of the surface by at least the width of the desk or credenzas and communication is hampered.

In addition, the standing height surface is not particularly useful as a common surface by people on opposite sides thereof. In the case of the receptionist workspace configuration, the receptionist typically uses the receptionist's desk top while a visitor uses the standing height surface and it is inconvenient for either the receptionist to use the standing height surface or for the visitor to use the receptionist's desk top.

In the case of a standing height surface above credenzas on either side of a wall that separates workspaces, while items can be placed on the standing height surface, the standing height surface is not very useful as a work surface for collaborative activities as a person on either side of the standing height surface would have to lean over one of the credenzas there below in order to access the standing height surface—an uncomfortable position at best.

In the case of a desk height table provided between first and second adjacent workspaces, while first and second people in the adjacent spaces can confidentially and comfortably collaborate at the common table while seated on chairs, the desk height table leaves the workspaces generally open to each other which substantially reduces the possibilities of configuring private sub-spaces within the workspaces. To this end, when a desk height table is provided between adjacent workspaces, the table does not block the line of sight of a seated person in one of the workspaces into the other workspace. Thus, even when seated within one of the workspaces, a person is not in a private space.

One other design feature for facilitating collaboration between two people has been to support a display screen above a desk surface on a sliding and rotating carriage such that the front surface of the screen is moveable to different positions and can be viewed by people on opposite sides of a desk. In these cases the supporting structures that facilitate sliding and rotating usually have several shortcomings. First, in some cases, the supporting structures include one or several components that reside above the desk top surface that impede use of the desk top. Where supporting structure components reside above the desk top the resulting configurations are also aesthetically unappealing.

Second, in other known cases where supporting structure is at least in part disposed below a desk top, the supporting structure extends downward from an undersurface of the desktop and impedes placement of legs there below. The solution in these cases has been to either mount the supporting structure below a lateral edge of the desk surface so that the display screen is laterally disposed with respect to a person using the desk or to provide a desk where the supporting structure is offset from a front edge of the desk (i.e., the edge adjacent the person using the desk) sufficiently that the when legs are placed under the desk, the legs will not contact the supporting structure. Thus, designs of display screen supporting structure have limited the overall options available for office space designers.

Thus, it would be advantageous to have a partition system for two people that defines a space that is physically separate from a larger office space and is at least somewhat private for use by the two people, that includes a shared or common work surface that is readily available for spontaneous use and where shared information can be maintained for long periods (e.g., several days or weeks), where the two people can, when desired, see each other during communication and where each of the two people has at least some private space for attending to personal or non-collaborative tasks. It would also be advantageous if the partition system provided at least some public space for interaction with persons outside each of the workspaces. Moreover, it would be advantageous if all of the advantages described above could be accomplished in a space similar to the space required for existing partition systems to support two people. Furthermore, it would be advantageous if a sliding support assembly were available that could support a display screen or other workspace accessories from a desk or other work surface where the support structure components are at least substantially disposed within a desk or other work surface member such that private and common or public surface configurations previously impractical could be designed.

BRIEF SUMMARY OF THE INVENTION

It has been recognized that a partition system can be designed for first and second people that includes each of a private space for the first person, a private space for the second person, a common space that facilitates spontaneous collaboration between the first and second people and a separate public space for each of the first and second people and that all of the se spaces can be provided in the area that was previously required to provide workspaces for two people using prior known partition systems. Thus, the advantages of collaboration between pairs of people can be had without giving up the advantages associated with prior types of partition configurations and without requiring additional space.

Consistent with the above realizations, in at least some embodiments of the invention, a partition system includes "full height" walls that enclose three sides of a space wherein the space includes two workstations. The workstations are separated at least in part by a "standing height" table top on top of a standing height partition wall wherein no credenza or desk height surfaces are provided below the table top. Because there are no encumbrances below the table top, people in the adjacent workstations can stand directly adjacent the table top which operates as a common surface. Because the common surface is a standing height surface, the common surface is comfortable for both people to use for spreading out documents, drawing, explaining information, etc., when standing. Because the partition wall below the common surface is standing height, when two people are seated on opposite sides of the partition wall, neither one of the people can see easily into the workstation on the opposite side of the wall and therefore the standing height wall in conjunction with other structure can be used to provide at least some sense of privacy to the space users when the users are seated. Because the common surface is completely contained within the space including the two adjacent workstations, documents and other materials disposed on the common surface can remain on the common surface for long periods (e.g., days or even weeks) as only the two people in the two workstations use the common surface.

According to another aspect of the present invention, privacy panels may be provided that are moveable adjacent a desk assembly such that the desk assembly and panels can be configured for either semi-private use or for relatively more public use. Thus, in at least some embodiments, panels are mounted to a rail adjacent a rear edge of a desk for sliding motion there along. Here, the panels can be slid into a storage position generally proximate one lateral edge of the desk or into an in use position disposed between first and second lateral edges of the desk to block at least some views into a desk user's space and onto the desk top. Here, the panels may extend above the rail, below the rail or both above and below the rail and may be between the desk and the rail or on the side of the rail opposite the desk.

According to one other aspect of the invention, a novel arm support assembly is provided that mounts to the table top and, more specifically, includes a track and carriage mechanism that is at least substantially entirely located within a table top member. For instance, in at least one embodiment the table top includes a slot that extends along the length of a track that is located within a table top and an extension or mounting member extends up through the slot. A display screen supporting arm can be mounted to the mounting member such that the arm and screen are moveable along the track. Here, because the track and carriage mechanism are located within the table top and there are no track or carriage components that reside above the table top surface, the track can be disposed in any part of the table top and along any horizontal axis independent of location with respect to the edge of the table along which a person is situated. Thus, for instance, the slot through which the mounting member extends can be placed along either the front or rear edge of a desk top and will not impede placement of legs there under.

According to another aspect of the invention, in at least some embodiments, one or more flat panel displays can be provided on the support arm which can be easily manipulated to alter their juxtaposition with respect to a rear edge of a desk (i.e., with respect to the public side of a desk) to either increase screen and desk top privacy or to open up the desk top for more public use or to share information on the display screens. Where flat panels displays are combined with the sliding privacy panels described above, the displays and panels can be manipulated to configure different combinations to increase to decrease privacy.

Consistent with the above, at least some inventive embodiments include a work space assembly for use by a pair of people where the pair of people include first and second persons, the system providing each of the first and second persons with a private space and also providing a shared to be shared by the pair of people during collaboration, the assembly comprising an enclosure wall having first and second distal wall edges that are within an opening plane, the enclosure wall forming a station space including one open side between the distal edges, a rear portion of the enclosure wall spaced a station depth from the opening plane, the enclosure wall having an enclosure height of at least forty-eight inches (i.e., high enough that a person of ordinary height that is seated on one side would not easily be able to see over and to the other side), a table top having a table top length dimension between first and second oppositely facing ends that is less than the station depth dimension, the top having a table height of between 40 (here the 42 inch height in addition to the width of the top together render $T_i$ difficult for a person of ordinary height seated on one side of the able to see over and to the other side of the table) and 52 inches and a space divider screen having generally oppositely facing first and second edges, first and second side surfaces and a divider height of at least sixty inches. In particularly advantageous cases the enclosure height is sufficient to impede a person of ordinary height standing on one side of a wall from looking thereover to the other side (e.g., 55-65 inches or more). Here, the table top is positioned with the table top length dimension substantially perpendicular to the rear portion of the enclosure wall and extending between the rear portion and the opening plane and the first edge of the space divider screen is positioned adjacent the second end of the table top with the space divider screen extending therefrom substantially parallel to the table top length dimension such that the top and the screen partition the station space into first and second subspaces.

In addition, the invention includes a work space assembly comprising a substantially planar rear wall member having a first height of at least forty-eight inches, first and second substantially planar side wall members extending perpendicular to and to the same side of the rear wall member from spaced apart locations along the rear wall member such that a station space is formed between the first and second side wall members and adjacent the rear wall member, a table top having a table top length dimension between first and second oppositely facing ends, the top having a table height of between forty and fifty-two inches and a space divider screen having generally oppositely facing first and second edges, first and second side surfaces and a divider height of at least sixty inches, first and second desk tops, each of the first and second desk tops having a front edge, a rear edge, first and second lateral edges, a desk height of between twenty-eight and thirty-two inches and a desk top length dimension between th first and second lateral side edges, wherein, the table top is positioned with the first end thereof adjacent and the table top length dimension substantially perpendicular to the rear wall member, the first edge of the space divider screen is positioned adjacent the second end of the table top with the space divider screen extending therefrom substantially parallel to the table top length dimension such that the top and the screen partition the station space into first and second subspaces, the first desk top positioned with the first lateral edge of the first desk top adjacent and the first desk top length dimension substantially perpendicular to the first side of the divider screen such that the first desk top extends toward the first side wall and a first entry space is formed between the second edge of the first desk top and the first side wall for accessing the first subspace and the second desk top positioned with the first lateral edge of the second desk top adjacent and the second desk top length dimension substantially perpendicular to the second side of the divider screen such that the second desk top extends toward the second side wall and a second entry space is formed between the second edge of the second desk top and the second side wall for accessing the second subspace.

Moreover, the invention also contemplates a table assembly for moveably supporting a table accessory, the assembly comprising a table top including upper and lower surfaces that define a top thickness, the top forming an elongated table channel having a channel length dimension that is substantially parallel to the top surface, a track having a track length dimension, wherein, at least one of the top forms a slot aligned with the channel length dimension and the track forms a slot along the track length dimension and a carriage supported by the track for movement along the track length dimension, a mounting member at least linkable to the carriage and including a distal end configured to support an accessory, wherein, both the track and the carriage are at least partially disposed within the table channel and at least partially within the thickness of the table top and the mounting member extends at least partially through the slot.

The invention also includes a table assembly for moveably supporting a table accessory, the assembly comprising a table top including upper and lower surfaces, the top forming an elongated slot in the top surface, a track having a track length dimension, the track mounted to the lower surface of the table top below the elongated slot such that the track length dimension is substantially aligned with the elongated slot, a carriage supported by the track for movement along the track length dimension, a mounting member at least linkable to the carriage and including a distal end configured to support an accessory, the distal end extending at least partially through the elongated slot and at least one roller supported by the carriage for rotation about a vertical axis and disposed so as to extend at least partially into the slot when the distal end extends at least partially therethrough.

Furthermore, at least some embodiments of the invention include a table and accessory support assembly, the assembly comprising a table top including upper and lower surfaces, front and rear edges and first and second lateral edges, the upper and lower surfaces defining a top thickness, the top forming an elongated slot in the top surface, a track having a track length dimension, the track mounted to the lower surface of the table top below the elongated slot such that the track length dimension is substantially aligned with the elongated slot, a carriage supported by the track for movement along the track length dimension, a mounting member at least linkable to the carriage and including a distal end, the distal end extending at least partially through the elongated slot and an arm member having first and second ends, the first end supported by the distal end of the mounting member for pivotal rotation about a substantially vertical axis and the second end extending from the first end such that the second end is positionable in at least a first position generally above the slot and a second position between the slot and the front edge of the table top, the second end configured to support an accessory.

In addition, according to certain aspects the invention contemplates a table assembly for moveably supporting a table accessory, the assembly comprising a table top including upper and lower surfaces that define a top thickness, the top forming an elongated table channel having a channel length dimension that is substantially parallel to the top surface and a support assembly mounted within the channel and within the table top thickness and including a mounting member having a distal end that extends at least partially through the slot and that is moveable there along, the distal end configured to support an accessory thereon.

The invention further contemplates embodiments including a screen apparatus comprising first and second rigid external members, each of the external members having oppositely facing internal and external surfaces, upper and lower edges and first and second oppositely facing lateral edges, an upper section, a mid-section and a lower section, each mid-section including a substantially planar member and at least one internal member, wherein the at least one internal member is sandwiched between the internal surfaces of the external members adjacent the mid-sections of the external members such that the midsections form an intermediate space therebetween and wherein the lateral edges of the first and second external members are at least in part exposed and the intermediate space is at least in part accessible along the lateral edges.

Some embodiments include a screen apparatus comprising first and second rigid external members, each of the external members having internal and external surfaces, upper and lower edges and first and second oppositely facing lateral edges, a mid-section, an upper section connected to the mid-section along an upper boundary and extending at an angle therefrom such that corresponding sections of the external surface form an angle less than one hundred and sixty degrees, and a lower section connected to the mid-section along a lower boundary and extending at an angle therefrom such that corresponding sections of the external surface form an angle less than one hundred and sixty degrees, each mid-section including a substantially planar member and at least one internal member having oppositely facing first and second surfaces and an edge between the first and second surfaces, wherein the at least one internal member is sandwiched between facing first surfaces of the mid-sections such that the first surfaces of the midsections form an intermediate space therebetween and wherein the lateral edges of the first and second external members are at least in part exposed and the intermediate space is at least in part accessible along side the lateral edges.

Other embodiments include a screen apparatus comprising a first rigid sheet member including a substantially planar mid-section and upper and lower sections that flare out to the same side of the midsection from upper and lower boundaries to upper and lower edges, respectively, the first sheet member also including first and second lateral edges and a second rigid sheet member including a substantially planar mid-section and upper and lower sections that flare out to the same side of the midsection from upper and lower boundaries to upper and lower edges, respectively, the second sheet member also including first and second lateral edges, wherein, the first and second sheet members are juxtaposed in a supporting relationship such that the mid-sections form an intermediate space therebetween with the upper section of the first sheet member diverging generally away from the second sheet member, the upper section of the second sheet member diverging generally away form the first sheet member, the lower section of the first sheet member diverging generally away from the second sheet member and the lower section of the second sheet member diverging generally away from the first sheet member.

In at least some cases the invention contemplates a space dividing assembly for use in an open space including a floor surface and at least one additional ambient surface, the assembly comprising a first support member supported by at least one of the ambient surface and the floor surface, a rail member supported by the support member at a rail height above the floor surface in a substantially horizontal orientation wherein the rail height is between twelve inches and thirty-six inches above the floor surface, a carriage mounted to the rail member for sliding motion there along and a screen member including first and second substantially oppositely facing surfaces and a screen edge between the first and second surfaces, the screen member supported by the carriage for motion therewith along the rail.

In addition, at least some inventive embodiments include a work space assembly for use by a pair of people where the pair of people include first and second persons, the system providing each of the first and second persons with a private space and also providing a shared to be shared by the pair of people during collaboration, the assembly comprising an enclosure wall having first and second distal wall edges that are within an opening plane, the enclosure wall forming a station space including one open side between the distal edges, a rear portion of the enclosure wall spaced a station depth from the opening plane, the enclosure wall having an enclosure height of at least sixty inches, divider components including a table top having a table top length dimension between first and second oppositely facing ends and a table height of between 40 and 52 inches and wherein, divider components are positioned with the table top length dimension substantially perpendicular to the rear portion of the enclosure wall and extending therefrom toward the opening plane, the divider components together partitioning the station space into first and second subspaces. Here, the table top length dimension may be similar to the station depth dimension.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
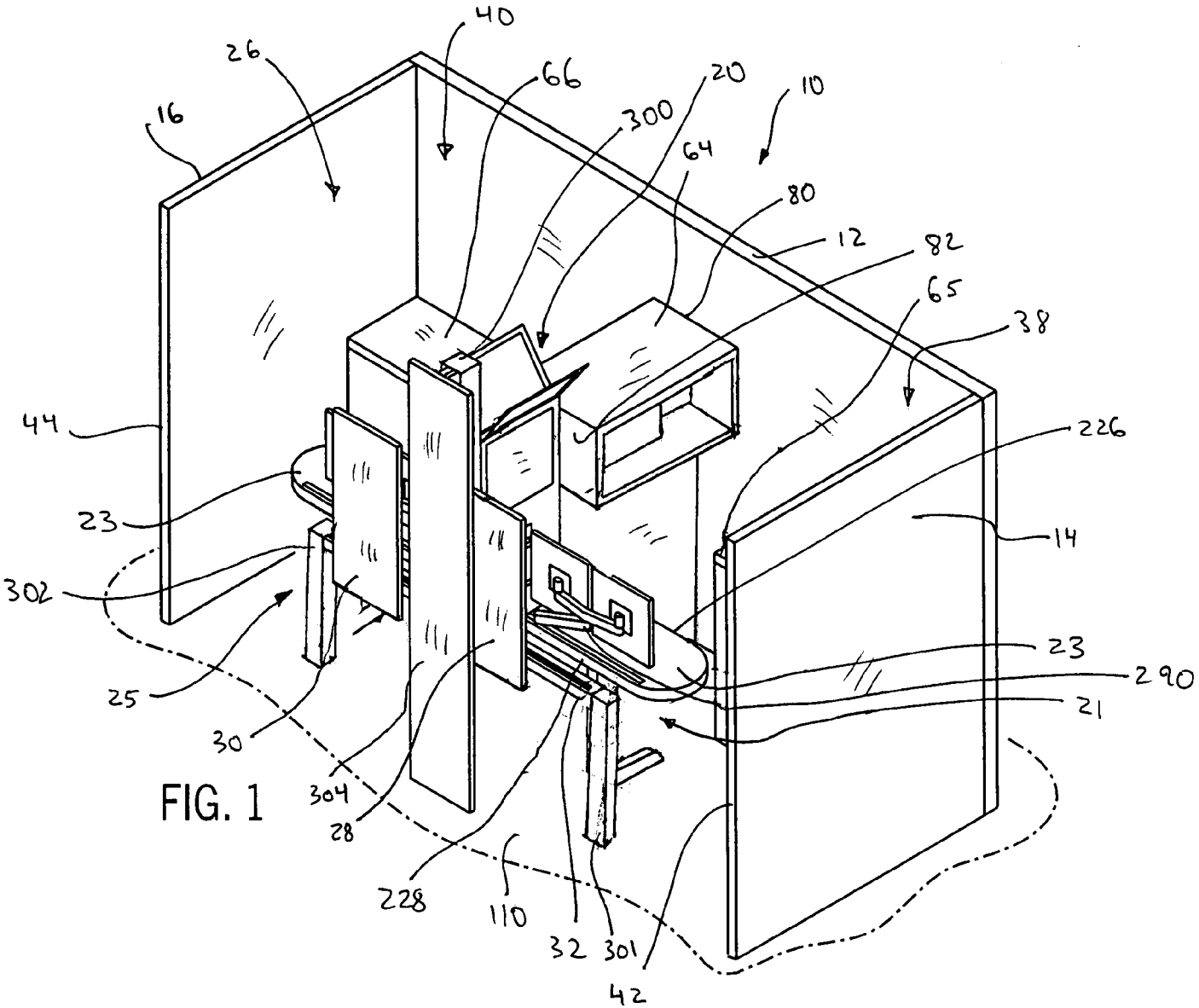
FIG. 1 is a perspective view of an exemplary partition system and configuration according to at least one aspect of the present invention.

While the present invention may be embodied in any of several different forms, the present invention is described here with the understanding that the present disclosure is to be considered as setting forth an exemplification of the present invention which is not intended to limit the invention to the specific embodiment(s) illustrated.

Referring now to the drawings wherein like reference numerals correspond to similar elements throughout the views and, more specifically, referring to FIGS. 1, 2, 3 and 6, the present invention will be described in the context of an exemplary multi-use office space partition system or configuration 10. System 10 includes an enclosure wall which, in the illustrated embodiment, include a rear wall 12, a first side wall 14 and a second side wall 16. In addition, system 10 includes a shared or common table assembly 18, a space divider wall or screen assembly 20, a first desk assembly 21, a second desk assembly 25, and a panel rail assembly 67. The common table 18 and screen 20 are referred to generally as divider components because they operate to divide space 26 into subspaces as described below.

The rear wall member 12 and first and second side wall members 14 and 16, respectively, together form a two person station space identified by numeral 26. To this end, in the exemplary embodiment, rear wall member 12 is a vertical generally rectilinear wall construct having a length dimension L0 between first and second lateral edges (not labeled) and a height dimension H1. While height H1 may have several dimensions, in at least some embodiments of the present invention, height dimension H1 is selected such that a person of ordinary height (e.g., 5 to 6 feet) standing on one side thereof would find it difficult or awkward to peer over wall member 12 from one side to the other. Thus, for example, in at least some cases, height H1 will be between 55 and 84 inches or may even extend to a ceiling height. In some cases height H1 may be as short as 48 inches which would, in at least some cases, be high enough to impede a person of average height and sitting on one side of the wall from peering over the wall to the other side. In some cases H1 may be 50 inches and in other cases 52 or more inches. Hereafter a height that impedes viewing thereover will be referred to as a "full height".

Each of first and second side wall members 14 and 16, respectively, like rear wall member 12, has a generally rectilinear shape and has a length dimension D1 and a height dimension H1. In the illustrated embodiment, the height of each of members 14 and 16 is identical to height H1 of rear wall member 12. Each of wall members 14 and 16 is rigidly connected to rear wall member 12 and extends perpendicular thereto, each of wall members 14 and 16 extending in the same direction from rear wall member 12 and from opposite ends thereof to first and second distal edges or ends 42 and 44, respectively, where ends 42 and 44 reside in a common plane (not labeled). The side of space 26 opposite rear wall member 12 is generally unobstructed by the enclosure wall structure described above.

Figure 2:
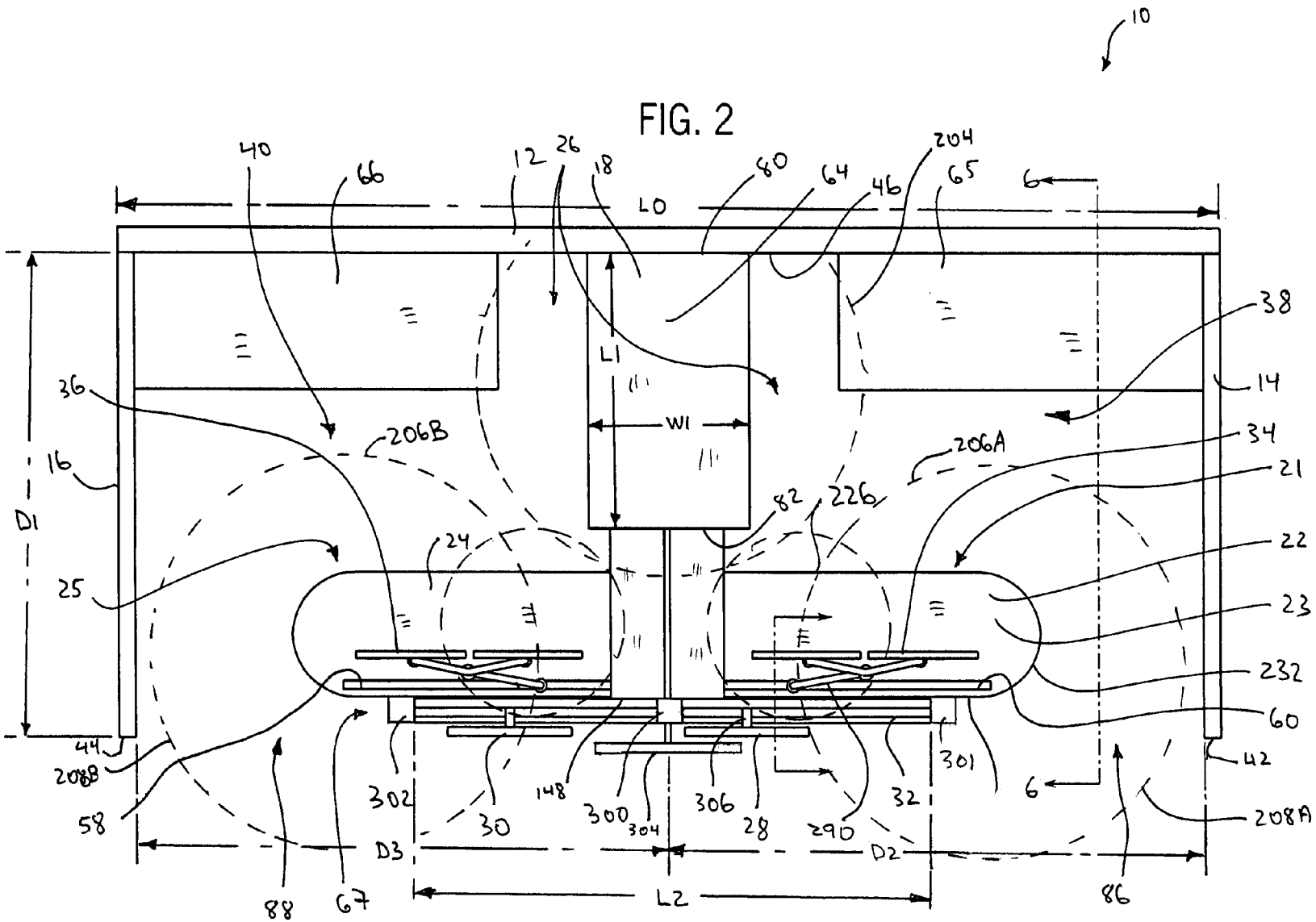
FIG. 2 is a top plan view of the configuration of FIG. 1.

Table assembly 18 and space divider screen 20 are positioned within station space 26 such that assembly 18 and screen 20 together divide space 26 into first and second subspaces 38 and 40, respectively. To this end, as best illustrated in FIG. 2, table assembly 18 includes first and second ends or wall members (i.e., edges) 80 and 82, respectively, first end 80 is positioned adjacent and extends from a rear portion 46 of the wall structure (i.e., the structure formed by wall members 12, 14 and 16) toward the opening between distal ends 42 and 44 and is aligned generally parallel to side walls 14 and 16. Space divider screen 20 extends from the second end 82 of table assembly 18 opposite rear wall 12 toward the space formed between distal ends 42 and 44. An edge 148 of space divider 20 opposite table assembly 18 is positioned approximately half way between distal ends 42 and 44 such that screen 20 generally divides the open side of the enclosure structure in half so that there are separate space openings 86 and 88 into first and second subspaces 38 and 40, respectively. Space openings 86 and 88 have dimensions D2 and D3, respectively, where each of dimension D2 and D2 is approximately half rear wall length dimension L0.

Referring still to FIGS. 1-3 and 6, panel rail assembly 67 includes three post members 300, 301 and 302, a horizontal rail member 32, a stationary screen member 304 and first and second slideable privacy panels 28 and 30. Posts 300, 301 and 302 support rail 32 at or just below a desk top height H7 (see FIG. 3) where the desk top height H7 is between 24 and 32 inches and along a portion of the open side of the enclosure wall structure.

Rail member 32 has a rail length dimension L2 that is approximately half the length dimension L0 of rear wall member 12 and is mounted such that approximately half of member 32 extends to each side of divider screen 20 and toward one of the distal edges 42 or 44 and such that member 32 is generally perpendicular to each of side wall members 14 and 16. Privacy screens 28 and 30 are mounted to rail member 32 in a manner to be described below.

Figure 10:
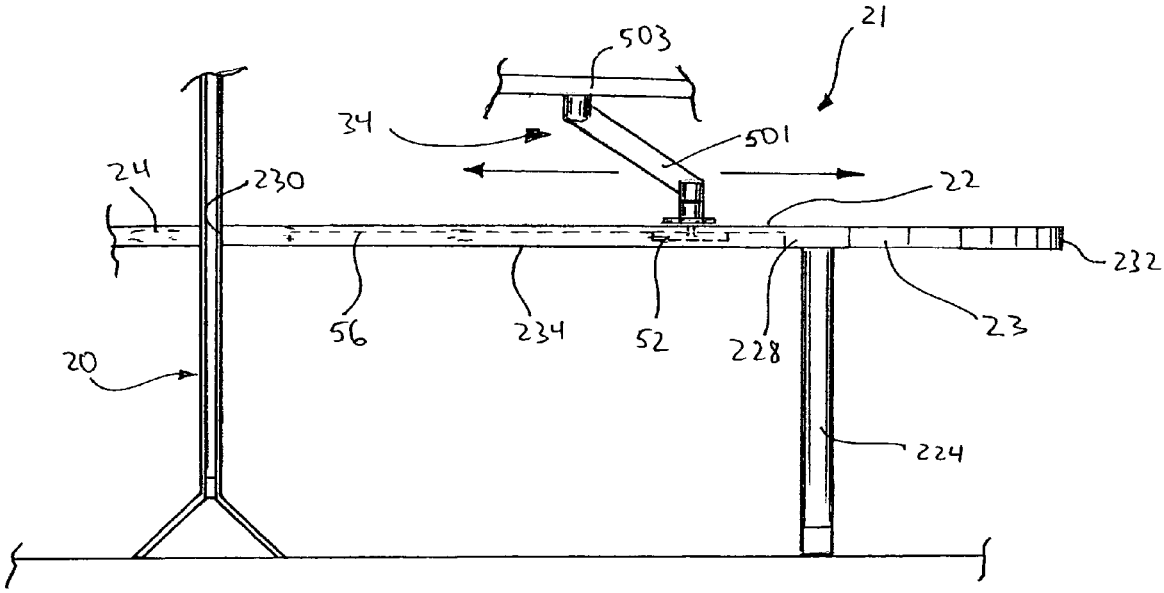
FIG. 10 is a front elevational view of one of the table assemblies of FIG. 1.
Figure 11:
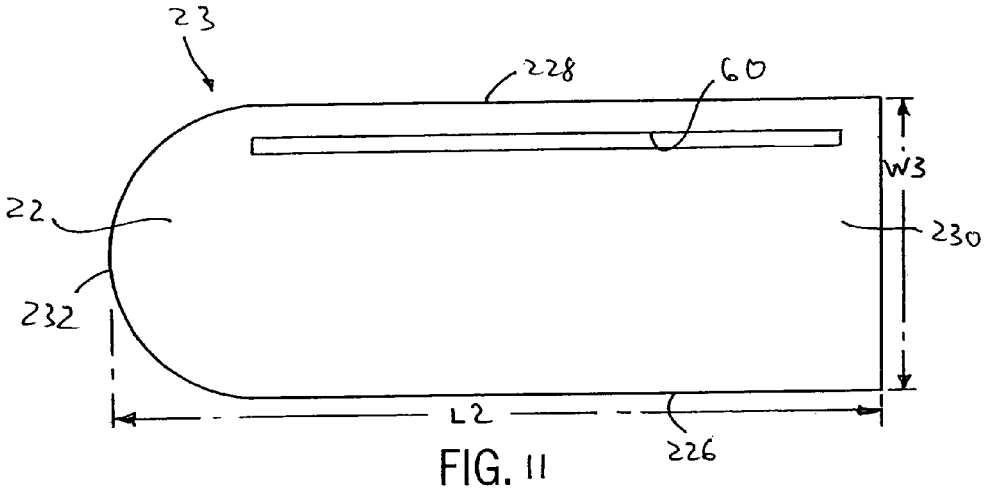
FIG. 11 is a top plan view of the tabletop of FIG. 10.
Figure 12:
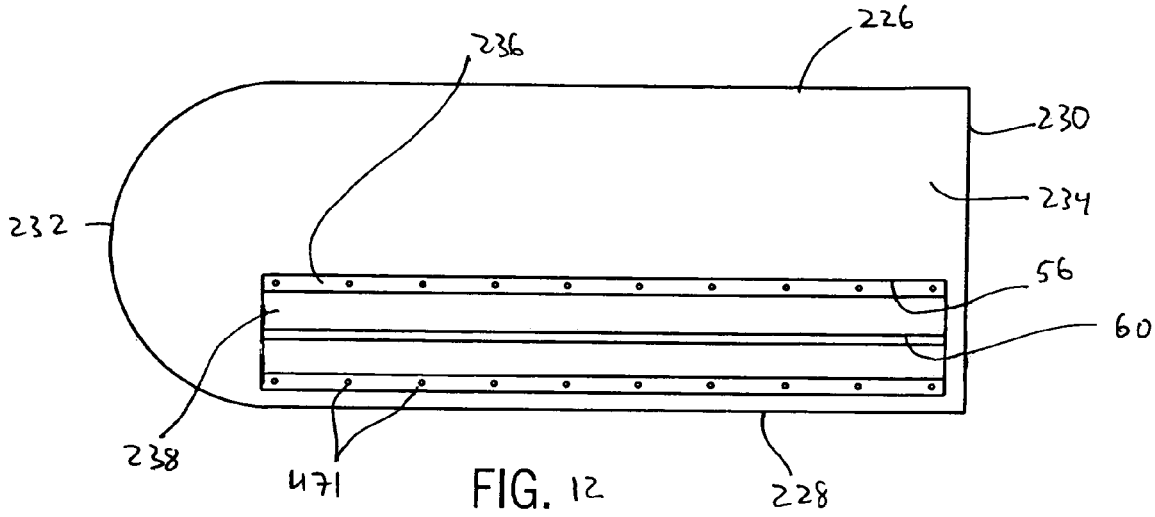
FIG. 12 is a bottom plan view of the tabletop of FIG. 10.

Referring still to FIGS. 1-3 and 6 and also to FIGS. 11 and 12, first desk assembly 21 includes a desk top member 23 having a top surface 22, oppositely facing front and rear edges 226 and 228 and oppositely facing first and second lateral edges 230 and 232, respectively (see also FIG. 11). Referring also to FIG. 10, member 23 is positioned such that first lateral edge 230 is adjacent divider screen 20 and member 23 extends away from screen 20 and toward a facing surface of side wall member 14 and to second edge 232. Desk top member 23 extends only part way to wall member 14 such that an access opening (not labeled) into subspace 38 is formed between desk top member 23 and wall 14. Similarly, second desk assembly 25 includes a desk top or tabletop surface 24 and is positioned between screen 20 and wall 16 with one end edge against screen 20 and the other end edge forming an access opening with a facing surface of wall member 16. The rear edges (e.g., 228) of the desk top members (e.g., 23) are aligned with and parallel to an adjacent edge of rail 32 (see again FIG. 2).

Referring still to FIGS. 1-3 and 6, each of dual monitor arm assemblies 34 and 36 is similarly constructed and operates in a similar fashion and therefore, in the interest of simplifying this explanation, only assembly 34 will be described in this specification with any detail. At this point, it should suffice to say that assembly 34 includes, among other components, first and second flat panel displays 200 and 202 that are mounted in at least some fashion adjacent rear edge 228 of desk top member 23. A particularly advantageous display mounting/supporting structure is described in greater detail below.

Prior to describing the detailed characteristics of each of the components described above, relatively generally characteristics will be described that are important to at least one aspect of the present invention. To this end, referring still to FIGS. 1-3, 6 and also to FIG. 4, table assembly 18 includes a table top member 64 having a top surface 84 that has a standing height dimension H2 and a width dimension W1 that render top 64 particularly useful and comfortable by persons standing on either side of assembly 18 for collaborative activities (e.g., sharing of documents, facilitating discussion, etc.). In addition, height H2 is selected such that assembly 18 blocks the line of sight between persons of ordinary height and anatomical build sitting on opposite sides thereof. For example, in at least some embodiments, the height of surface 84 is between 40 and 52 inches and, in particularly useful cases, the height of surface 84 is between 42 and 44 inches such that top 64 is useful for persons standing to collaborate but is sufficiently high such that persons sitting on opposite sides thereof have at least some degree of privacy. In addition, referring still to FIGS. 1-4 and 6, in general, the kick space below surface 84 is open and no credenza or work surface is provided therebelow such that people collaborating on opposite sides of top member 64 can be positioned directly adjacent lateral edges thereof without lower obstructions impeding activity.

Exemplary width W1 of table top member 64 may be anywhere between 15 and 30 inches and, in particularly advantageous embodiments, will be between 20 and 24 inches. Here, it has been found that smaller widths such as, for instance 10 inches, are insufficient for supporting materials used by two people during collaboration and also result in configurations that are difficult to approach from lateral edges as feet or knees therebelow tend to knock against a facing surface of a support wall therebelow. In addition, it has been found that if the width W1 is too large, people on opposite sides thereof are too far apart to communicate most effectively.

Figure 6:
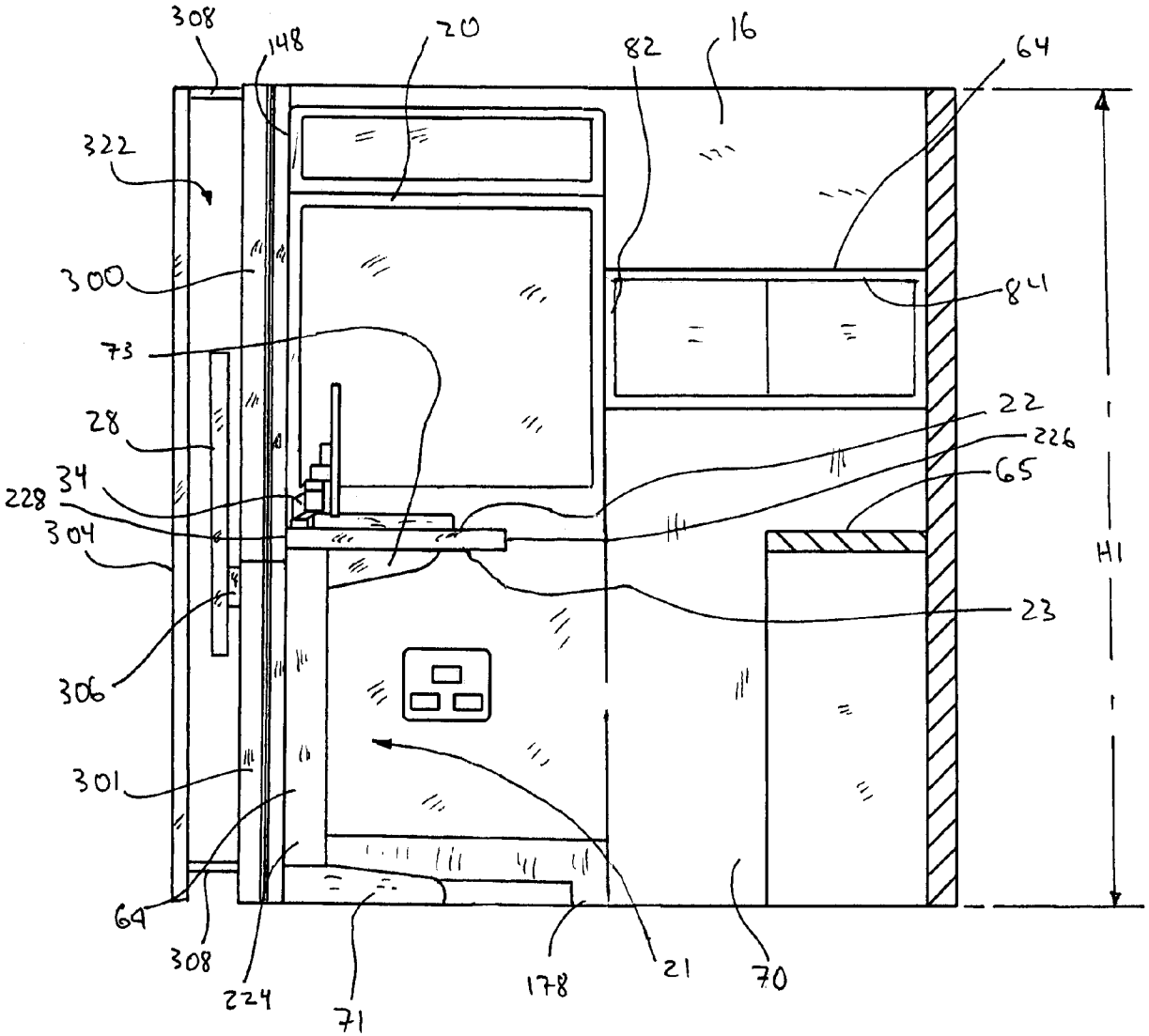
FIG. 6 is an elevational and partial cross sectional view taken along the line 6-6 of FIG. 2.
Figure 7:
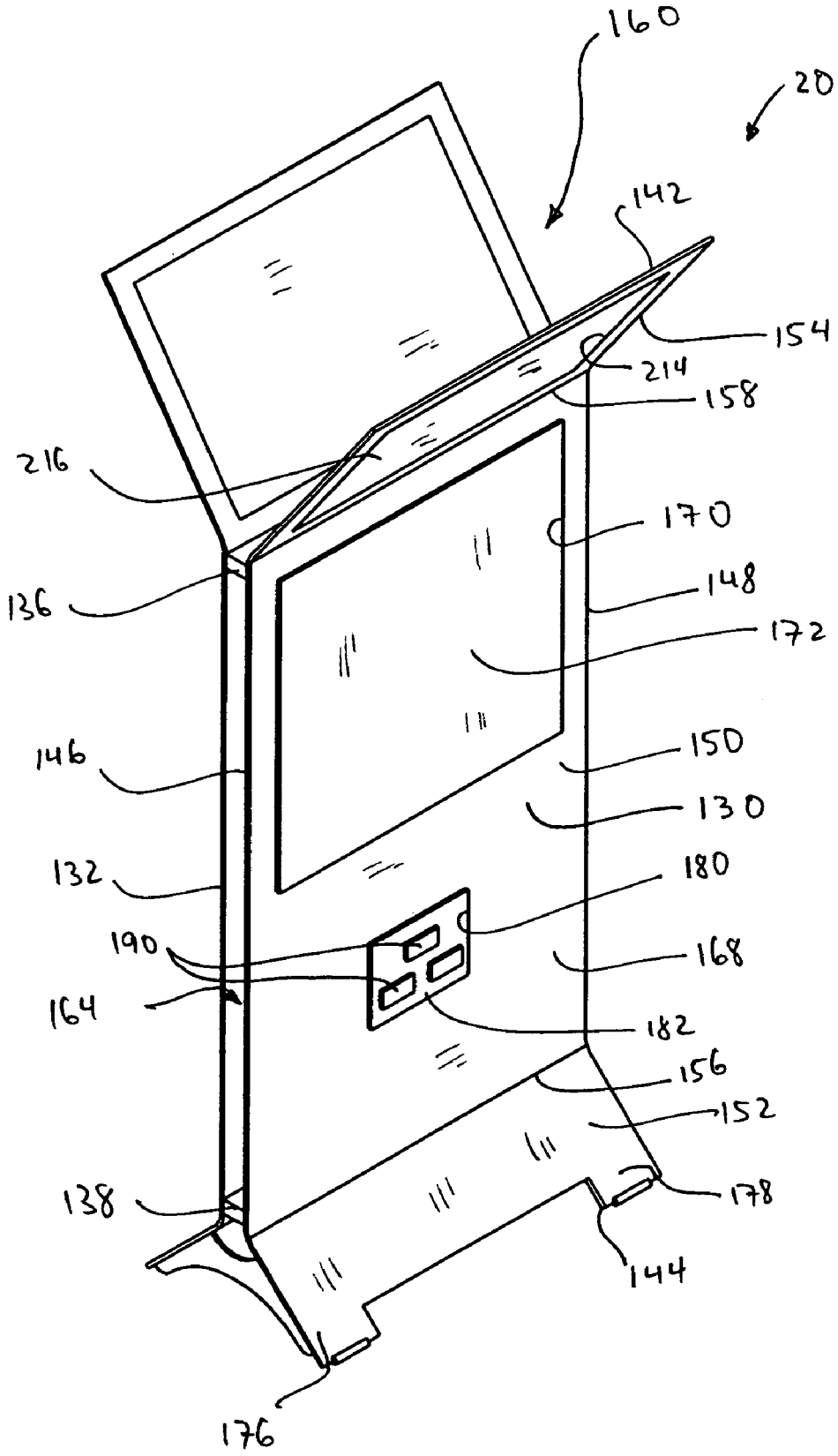
FIG. 7 is a perspective view of the space dividing screen of FIG. 1.
Figure 9:
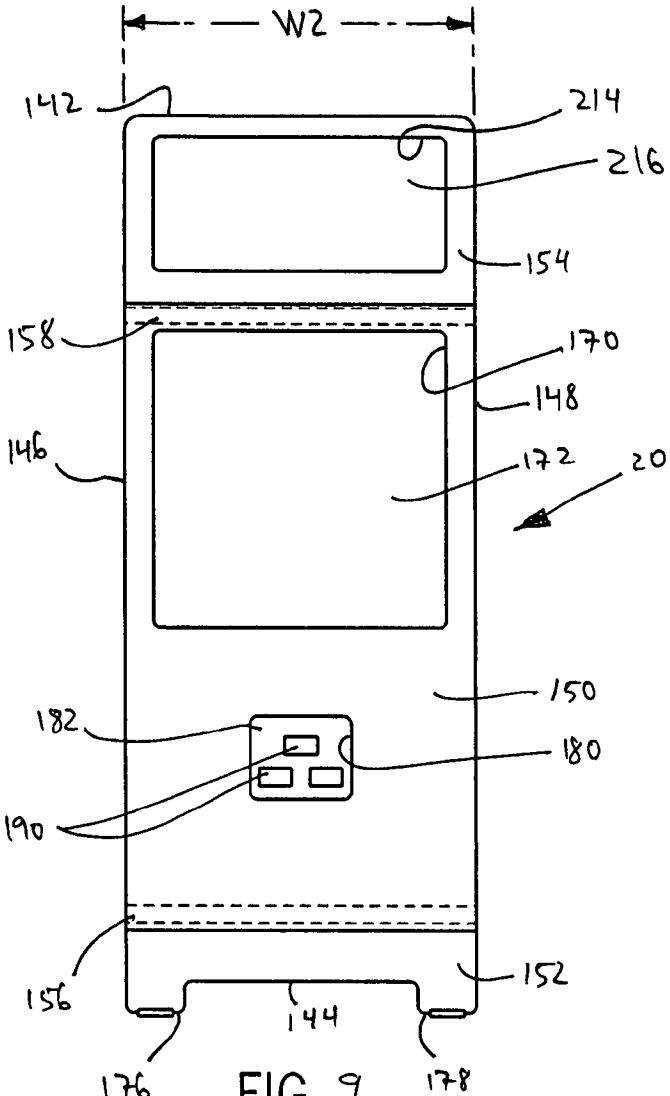
FIG. 9 is a side elevational view of the screen of FIG. 7.
Figure 8:
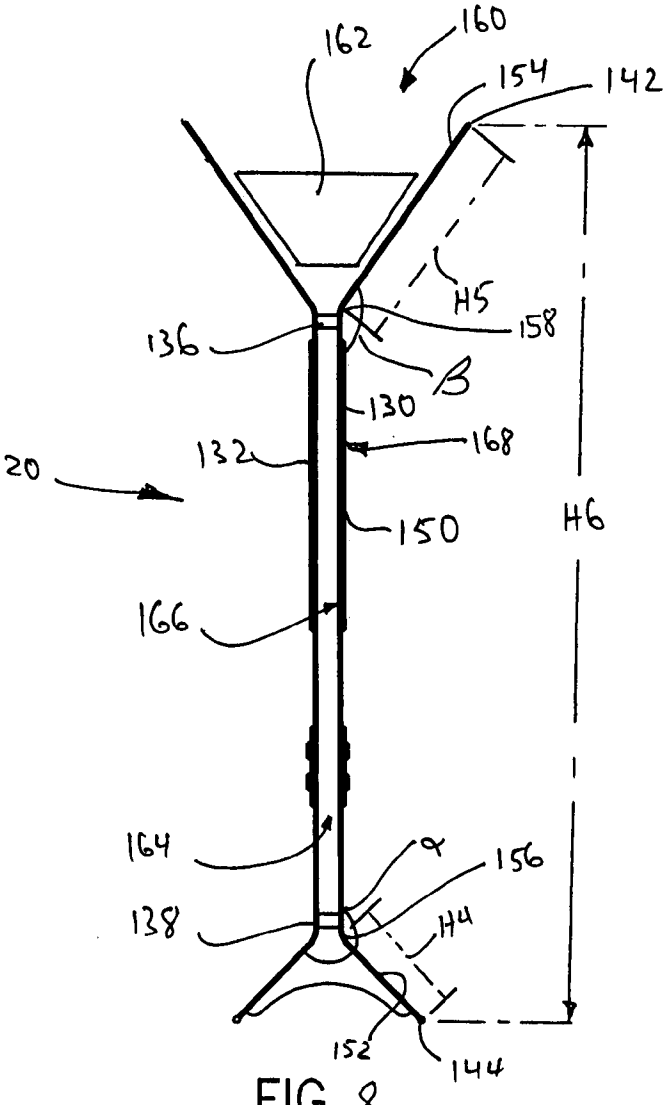
FIG. 8 is an end view of the screen of FIG. 7.

Referring again to FIGS. 1 through 3 and also to FIGS. 7, 8 and 9, space divider screen 20 is designed to have a height dimension H6 that can block or at least substantially impede a person on one side thereof from looking over to the other side. To this end, as in the case of wall members 12, 14 and 16, screen 20 will typically have an overall height of between 60 and 84 inches. In addition, screen 20 has a width dimension W2 (see also FIG. 6) that is selected such that screen 30 extends past the front edges (e.g., 226) of the desk top members (e.g., 23) so that when a person is sitting at one of the desk assemblies 21 or 25 in a first of subspaces 38 or 40 and adjacent screen 20, screen 20 at least impedes a person in the other of the subspaces 38 or 40 from observing the seated person. For example, screen width dimension W2 may be anywhere between 25 and 45 inches, depending on the dimensions of the adjacent desks assemblies 21 and 25.

At this point is should be appreciated that the general layout or configuration 10 described above functions to define various subspaces within station space 26 that are useful for different purposes. To this end, referring specifically to FIG. 2, first, a collaborative space 204 particularly useful for collaboration between a first person within subspace 38 and a second person within subspace 40 exists about table assembly 18 where the pair of people can spread out documents on tabletop 64, can share ideas in comfort and generally confidentially, and where the two people can leave information for long periods of time if desired. Here, as described above, each of the pair can move to a position directly next to one of the lateral edges of top 64 and is not impeded by a desk or credenza height surface or other obstructing structure there below.

Second, relatively private spaces 206A and 206B are formed adjacent the front edges (e.g., 226) of the desk top members (e.g., 23 and 24) and adjacent divider screen 20 wherein a person can perform relatively private activities. In this regard, referring still to FIG. 2, it should be appreciated that when a person is working on desk top surface 22, views of the person at desk assembly 21 and the person's work on the top thereof are blocked or at least substantially impeded from three sides by side wall 14, rear wall 12 and screen 20. In addition, when privacy panel 28 is positioned adjacent the rear edge 228 of top 23, views into space 38 and on to top surface 22 are at least impeded from the four direction. Moreover, when displays 200 and 202 are arranged so that they face into space 38, displays 200 and 202 further impede views from the fourth direction. In particular, when displays 200 and 202 are positioned to face into space 38, views of the display screens themselves are substantially impeded from all directions from locations outside subspace 38. The comments above with respect to private space 206A are applicable to private 206B that is formed within subspace 40.

Referring still to FIG. 2, third relatively public spaces are defined by configuration 10 within each of subspaces 38 and 40. The relatively public spaces in subspaces 38 and 40 are identified by numerals 208A and 208B, respectively. Public space 208A is formed at the end of table top member 23 adjacent edge 232 where edge 232 is rounded so as to "invite" people to gather therearound and collaborate in groups of two or more. Here, the occupant of subspace 38 resides generally to front edge side 226 of desk top member 23 and other collaborators gather around the round edge 232 and the oppositely facing rear edge 228. Here, panel 28 can be moved along rail 32 away from edge 232 and, in at least some embodiments, display screens 200 and 202 can be moved away from edge 232 thereby opening up the rear edge 228 of top member 23 to accommodate additional collaborators during conference activities. When space 206A is to be used privately, privacy panel 28 and screens 200 and 202 can again be moved out and positioned along rear edge 228 to convert desk top member 23 into a more private space.

A. Common Table Assembly

Figure 4:
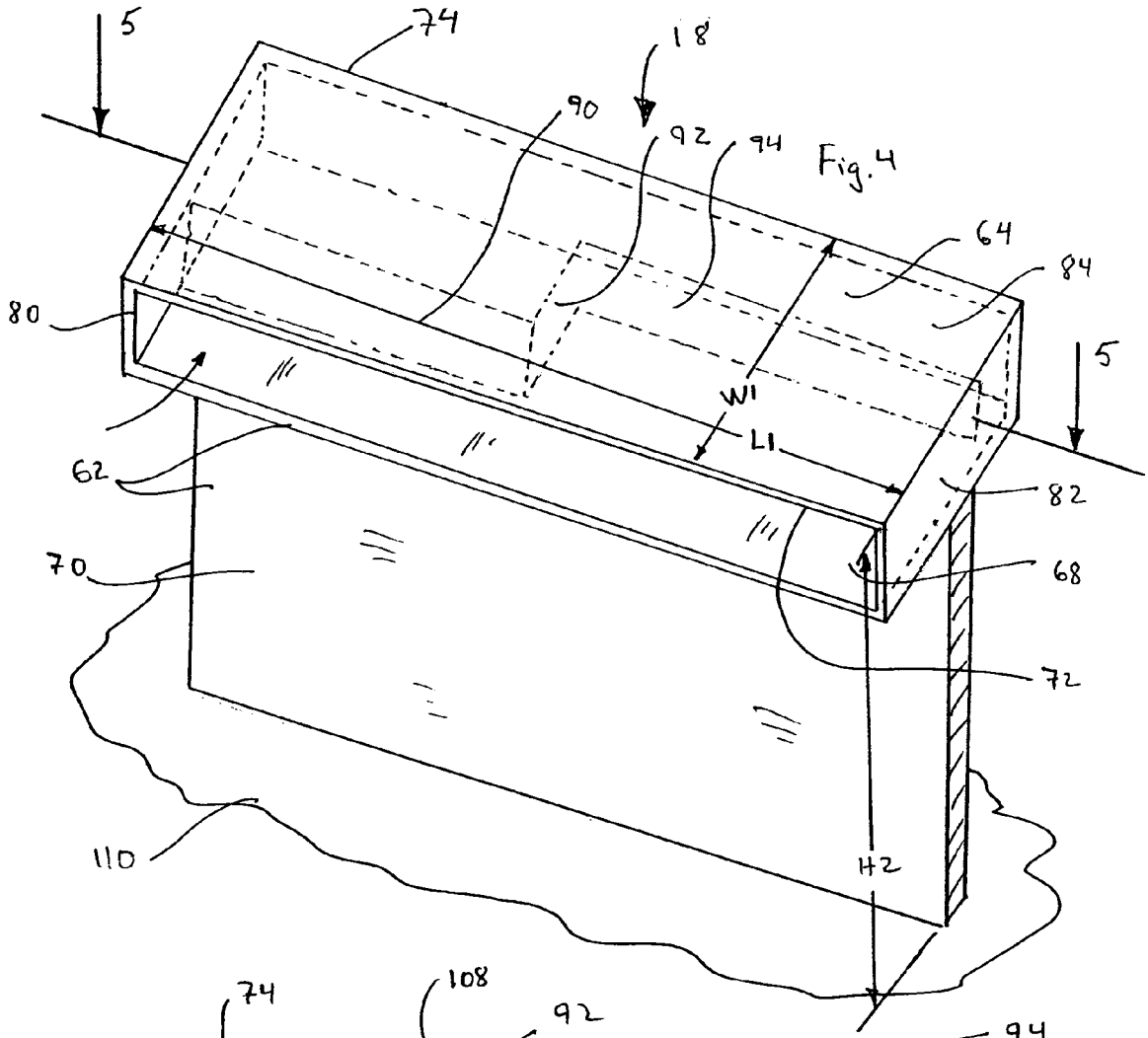
FIG. 4 is a perspective view of the common table assembly of FIG. 1.
Figure 5:
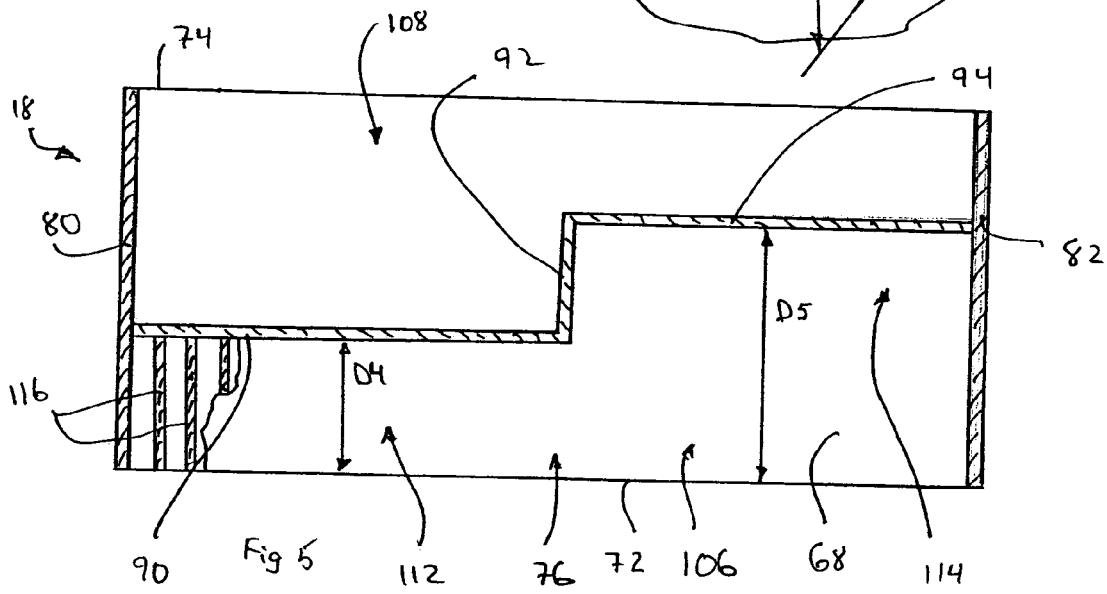
FIG. 5 is a cross section view taken along the line 5-5 of FIG. 4.

Referring once again to FIG. 4 and also to FIG. 5, table assembly 18 includes top member 64 having top surface 84 and a table top support structure 62 therebelow. The exemplary support structure 62 rests on an ambient floor surface 110 and supports top member 64 thereabove. In at least some embodiments, support structure 62 includes a conventional partition wall assembly 70 like those manufactured and sold by various industry members. In addition to partition or divider wall 70, the support structure 62 also includes various members that form a shelf space below top member 64. To this end, the shelf forming components include a bottom wall 68, first and second lateral walls 80 and 82 and central wall structure including three internal walls 90, 92 and 94. Each of top member 64 and bottom wall 68 are similarly shaped and have similar dimensions and therefore, bottom wall 68 has length and width dimensions L1 and W1, respectively. Top member 64 and bottom wall 68 are separated by lateral walls 80 and 82 which are similarly dimensioned and sized and which traverse the distance between top member 64 and bottom wall 68 at adjacent edges thereof such that member 64 and walls 80, 82 and 68 form a three-dimensional rectilinear space 76 therebetween having first and second lateral edges 72 and 74, respectively.

Each of internal walls 90 and 94 has a length dimension approximately half of length L1, traverses the distance between top member 64 and bottom wall 68 and is generally parallel to the first and second lateral edges 72 and 74, respectively, of space 76, with wall 90 relatively closer to first lateral edge 72 than second lateral edge 74 and having one end contacting end wall 80 and wall 94 relatively closer to second lateral edge 74 than first lateral edge 72 and having one end contacting end wall 82. Internal wall 92 is parallel to end walls 80 and 82 and extends between distal ends of walls 90 and 94. Thus, as best illustrated in FIG. 5, space 76 is divided into two separate spaces 106 and 108 where space 106 is accessible from below top member 64 adjacent first lateral edge 72 and space 108 is accessible below top member 64 adjacent second lateral edge 74. In addition, each of spaces 106 and 108 includes two spaces having different depth dimensions. A first relatively shallow depth dimension D4 is formed between edge 72 and wall 90 while a second relatively deeper dimension D5 is formed between edge 72 and wall 94. In at least some cases, additional dividers 116 may be provided in any of the internal spaces formed by the top member 64 and the wall members described above, two exemplary dividers identified by numerals 116.

The exemplary table assembly 18 of FIGS. 4 and 5 has several advantages. First, as indicated above, except for the supporting wall structure 70 that supports other table assembly components, no other structure is provided below bottom wall member 68 and therefore a person can move directly adjacent each lateral edge 72, 74, without feet or knees interfering with structure below the top member 64—this is particularly true in cases where width W1 is greater than 20 inches.

Second, while the space below knee level should be open and unobstructed, it has been recognized that storage structure can be placed directly below top member 64 without impeding placement of feet and knees when a person stands next to and uses top member 64. Experiments have shown that the dimension (not labeled) between facing surfaces of top member 64 and bottom wall 68 may be sufficiently large to accommodate a binder (e.g., 12 plus inches). In some embodiments it is contemplated that the dimension between facing surfaces of member 64 and bottom wall 68 will be sufficient to receive compact disc cases.

B. Divider Screen Assembly

Figure 3:
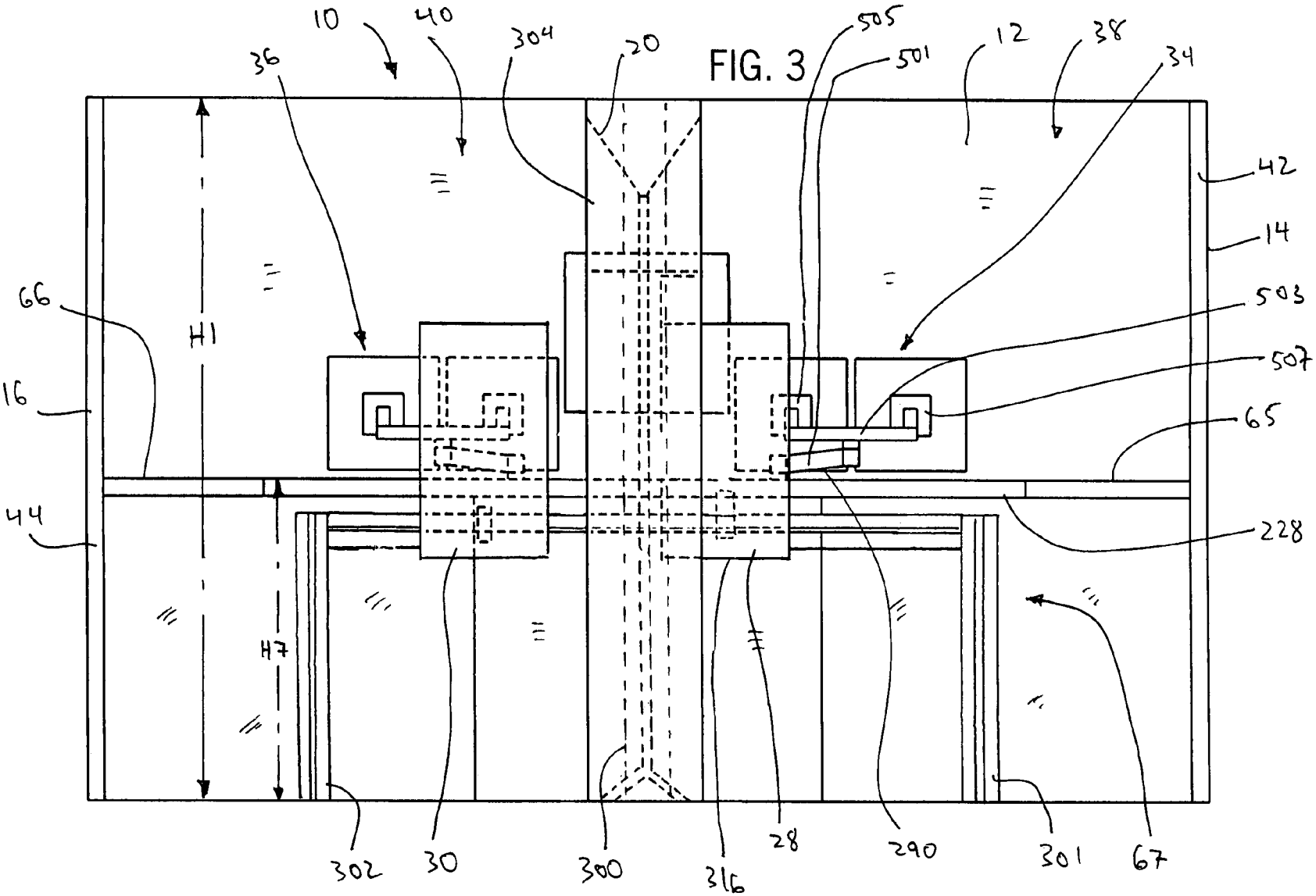
FIG. 3 is a front elevational view of the configuration of FIG. 1.

Referring still to FIGS. 1 through 3 and also to FIGS. 7-9, divider screen 20 includes first and second external members 130 and 132 and first and second internal separating or spacing members 136 and 138, respectively. Each of external members 130 and 132 is similarly configured and operates in a similar fashion and therefore, in the interest of simplifying this explanation, only structural member 130 will be described here in detail.

Member 130 is generally a rectangularly shaped aluminum sheet member having a relatively minimal thickness between oppositely facing internal and external surfaces 166 and 168, respectively, sufficient to maintain its shape. In this regard, the thickness of member 130 may be anywhere between ⅛ of an inch and ½ of an inch and, in a particularly advantageous embodiment, member 130 will be approximately $3/8^{th}$ to $1/4^{th}$ of an inch thick. Member 130 is defined by a top edge 142, a bottom edge 144, a first lateral edge 146 and a second lateral edge 148. External member 130 includes three separate planar sections that are separated by upper and lower fold lines or boundaries 158 and 156, respectively. Upper section 154 includes the portion of member 130 between upper edge 142 and upper fold line or boundary 158. Mid-section 150 includes the portion of external member 130 between upper boundary 158 and lower boundary 156. Lower section 152 includes the portion of external member 130 between lower boundary 156 and lower edge 144. Each of boundaries 158 and 156 is generally straight and, in the illustrated embodiment, is parallel to an adjacent one of the upper and lower edges 142 and 144, respectively. Thus, each of upper section 154, mid-section 150 and lower section 152 is substantially rectilinear when viewed in side elevation (see FIG. 9).

Lower section 152 bends away from mid-section 150 along the lower fold line 156 in a first direction such that portions of external surface 168 of member 130 associated with mid-section 150 and lower section 152 form an obtuse angle α. Angle α is selected in conjunction with the dimensions of lower section 152 such that when screen 20 components are assembled as described herein, the lower edges 144 of the external members 130 and 132 form a stable base for other screen components thereabove. In this regard, depending upon other screen component dimensions, angle α may be anywhere between 100 and 150 degrees. In particularly advantageous embodiments, angle α is between 125 and 135 degrees.

Upper section 154 bends away from mid-section 150 along upper fold line 158 to the same side of mid-section 150 as does lower section 152 such that the portions of external surface 168 associated with upper section 154 and mid-section 150 form an angle β. Here, angle β may be almost any obtuse angle and, in particularly advantageous and esthetically pleasing embodiments, will be 125 and 135 degrees. In at least some embodiments, like the embodiment illustrated in FIG. 8, angles α and β may be substantially similar.

Referring in particular to FIG. 8, upper section 154 has a height dimension H5 between boundary line 158 and top edge 142 while lower section 152 has a height dimension H4 between bottom edge 144 and lower boundary line 156. In at least some embodiments, dimension H4 is between 6 and 24 inches, the actual dimension required to provide stability to screen 20 being a function of angle α as well as dimensions of other screen components. Thus, for example, where overall screen height H6 is relatively high, assuming a constant angel α, height H4 may have a large dimension to provide more lateral support for screen 20 components. Similarly, where height H6 is constant but angle α is increased, height H4 may have to be increased to provide more lateral support. In at least some cases, dimension height H5 may be approximately twice dimension height H4 as is the case in the illustrated embodiment. Height H6 may be anywhere between 60 inches and 90 inches and in some cases will be 72 inches.

Referring still to FIGS. 7-9, internal members 136 and 138 are, in at least the illustrated embodiment, elongated members that have length dimensions that are similar to the width dimension W2 between lateral edges 146 and 148 of external members 130 and 132. Members 136 and 138 are mounted between external members 130 and 132 in substantially horizontal orientations with member 136 proximate fold line 158 and member 138 proximate fold line 156. Internal members 136 and 138 may be secured between external members 130 and 132 in any manner including, screws, bolts, epoxy or any other known mechanical mechanism.

Members 136 and 138 have relatively narrow vertical width dimensions (not labeled) such that, when members 136 and 138 are mounted between external members 130 and 132, an intermediate space 164 is formed between the facing internal surfaces (e.g., 166) of external members 130 and 132. Between the internal surfaces of members 130 and 132 an intermediate space dimension (not labeled) will be anywhere between ½ an inch and 3 inches and, in a particularly advantageous embodiment, will be approximately 2 inches.

In the illustrated embodiment, as best seen in FIGS. 7 and 9, bottom edge 144 is contoured such that the edge 144 forms first and second foot members 176 and 178 adjacent lateral edges 146 and 148, respectively. In other embodiments edge 144 may simply be a straight edge without contour.

When the components described above are assembled to form screen 20, in addition to forming intermediate space 164 between the mid-sections (e.g., 150) of members 130 and 132, an upper space 160 is formed between the upper sections (e.g., 154) of members 130 and 132. Space 160 can be used to mount or store various types of accessories. For instance, label 162 in FIG. 8 schematically illustrates a light fixture disposed within space 160. Light fixture 162 may shine light upward and thereby provide indirect light or, in the alternative, may shine light downward to provide a direct light source. Where light 162 directs light downward, as best illustrated in FIG. 9, an upper screen opening 214 may be provided within upper section 154 and a translucent panel 216 may be mounted within opening 214 such that light emanating from lighting device 162 passes therethrough. Although not illustrated, other accessories that may be included within space 160 include audio speakers, electronic sound suppression systems, video displays, etc.

Referring still to FIGS. 7, 8 and 9, one or more openings may also be formed within each of external members 130 and 132 to accommodate other accessory components that enable other functions. For example, a relatively large opening 170 may be formed by mid-section 150 and some type of functional panel 172 may be mounted therein. Exemplary functional panels 172 include, but are not limited to, whiteboards, blackboards, tack boards (i.e., boards that receive tacks), tacky boards (i.e., boards that have a tackiness to them so that transparencies or the like are mountable thereto), etc. In one particularly advantageous embodiment, a tack board may be provided within opening 170 by covering a corkboard or the like with material and forcing the board and material through opening 170 from the internal surface 166 of member 130 such that the fabric covered external face of the board protrudes slightly through opening 170. Here, where the board has sufficient thickness, opposite surfaces of the board may protrude through openings like opening 170 formed by opposing members 130 and 132.

As another instance, referring still to FIGS. 7 through 9, an opening 180 may be formed in mid-section 150 for receiving a utility insert plate 182 that in turn receives utility outlets 190. Here, outlets 190 may include power and/or data/communication outlets and power and data/communication cables may be strung through intermediate space 164 to outlets 190 as appropriate.

C. Table Assemblies

Referring once again to FIGS. 1-4, each of desk or table assemblies 21 and 25 is similarly constructed and operates in a similar fashion and therefore, in the interest of simplifying this explanation, only table assembly 21 will be described here in detail. Referring also to FIGS. 6 and 10 through 12, table assembly 21 includes a table top member 23 and leg structure 224 therebelow that supports top member 23 above an ambient floor surface 110.

In the illustrated embodiment one edge 230 of member 23 is mounted to a facing external surface of screen 20 and leg structure 224 includes only a single leg member 69, a foot member 71 and an arm member 73 that together support top member 23. Edge 230 may be mounted to screen 20 by brackets (not illustrated) or the like. Leg member 69 is vertical. Foot member 71 and arm member 73 extend in the same direction from opposite ends of and generally perpendicular to leg member 69. Foot member 71 rests on an ambient surface 110 while top member 23 is mounted to the top of arm member 73 proximate edge 232 such that arm member 73 generally extends from rear edge 228 toward front edge 226. Leg structure 224 is dimensioned so that the top surface of table top member 23 is between 24 and 32 inches high.

As indicated above, top member 23 includes a front edge 226, a rear edge 228 and first and second lateral edges 230 and 232, respectively. Lateral edges 230 and 232 define a desk top length dimension L2 while front and rear edges 226 and 228, respectively, define a width dimension W3 (see FIG. 11) where length dimension L2 is generally greater than width dimension W3. Referring to FIG. 2, length dimension L2 is generally less than dimension D2 opening of 86 such that when first lateral edge 230 is adjacent dividing screen 20, second edge 232 is spaced from a facing surface of side wall member 14 and an access opening (not labeled) is formed therebetween. As seen best in FIG. 11, a slot 60 is formed in top member 23 that is generally parallel to rear edge 228 and that opens through top member 23 from the top surface 22 through to the undersurface 234.

Figure 15:
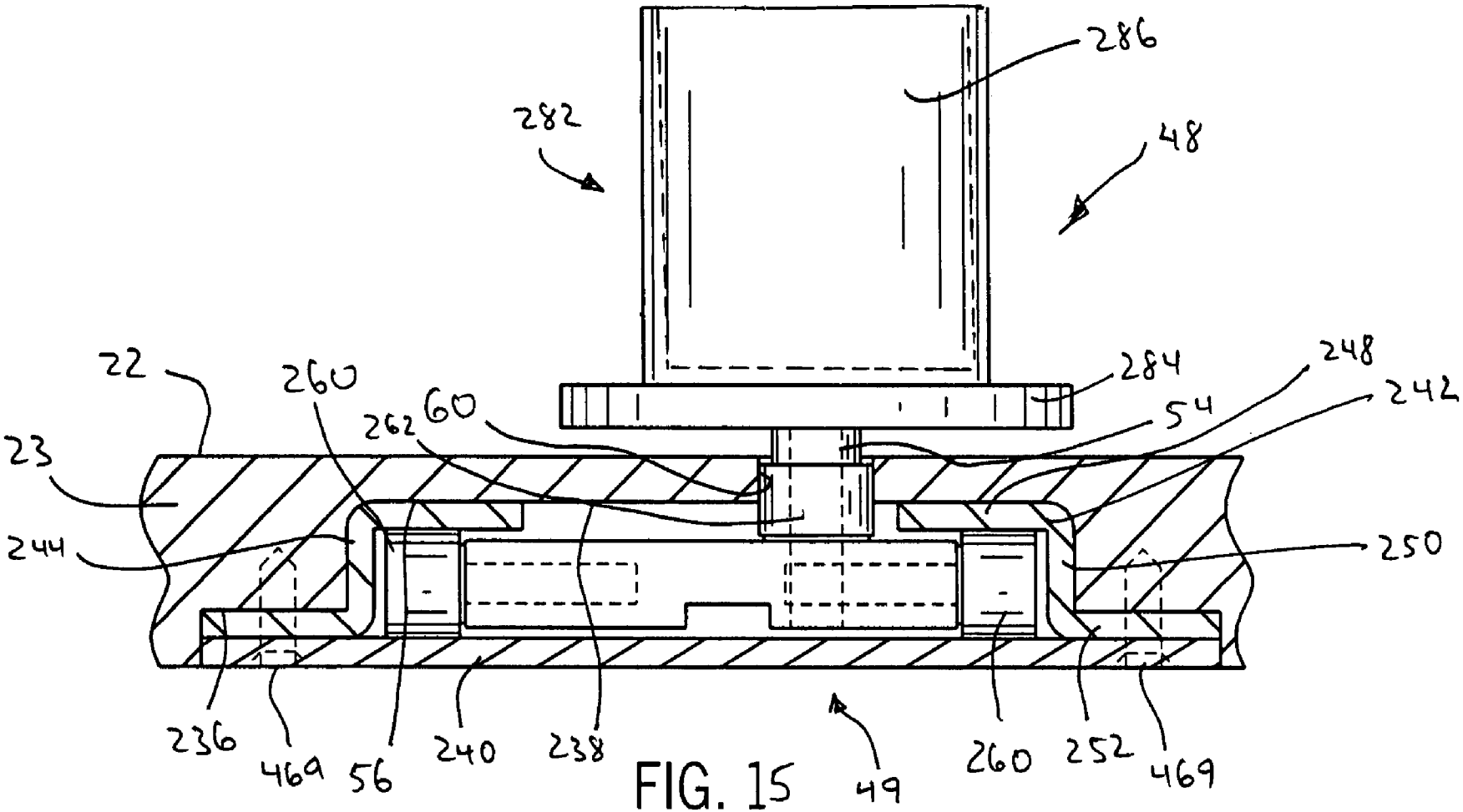
FIG. 15 is a cross sectional view showing the undersurface assembly of FIG. 13 mounted within the recess illustrated in FIG. 12.

Referring now to FIGS. 12 and 15, top member 23 forms a channel or recess 56 in undersurface 234 that generally extends along and parallel to slot 60. Recess 56 is a two-tier recess where a first tier 236 has a relatively narrow depth dimension and a central second tier 238 has a relatively deeper depth dimension. For example, while shallow tier 236 may have a recessed depth of $1/4^{th}$ inch, deeper tier 238 may have a recessed depth dimension of $3/4^{th}$ inch. Second tier 238 is formed within first tier 236 such that slot 60 opens into second tier 238 and such that first tier 236 includes portions that extend along opposite side of second tier 238 that are generally parallel with slot 60 (i.e., first tier 236 has portions between second tier 238 and each of the front and rear edges 226 and 228, respectively, of member 23). In at least some embodiments, as best seen in FIG. 15, slot 60 is offset within second tier 238 to the rear edge 228 of member 23. By offsetting the slot to the rear edge 228 where the accessory or monitor arm is expected to extend toward the front edge 226 at most times allows for a more stable carriage-track assembly.

Figure 13:
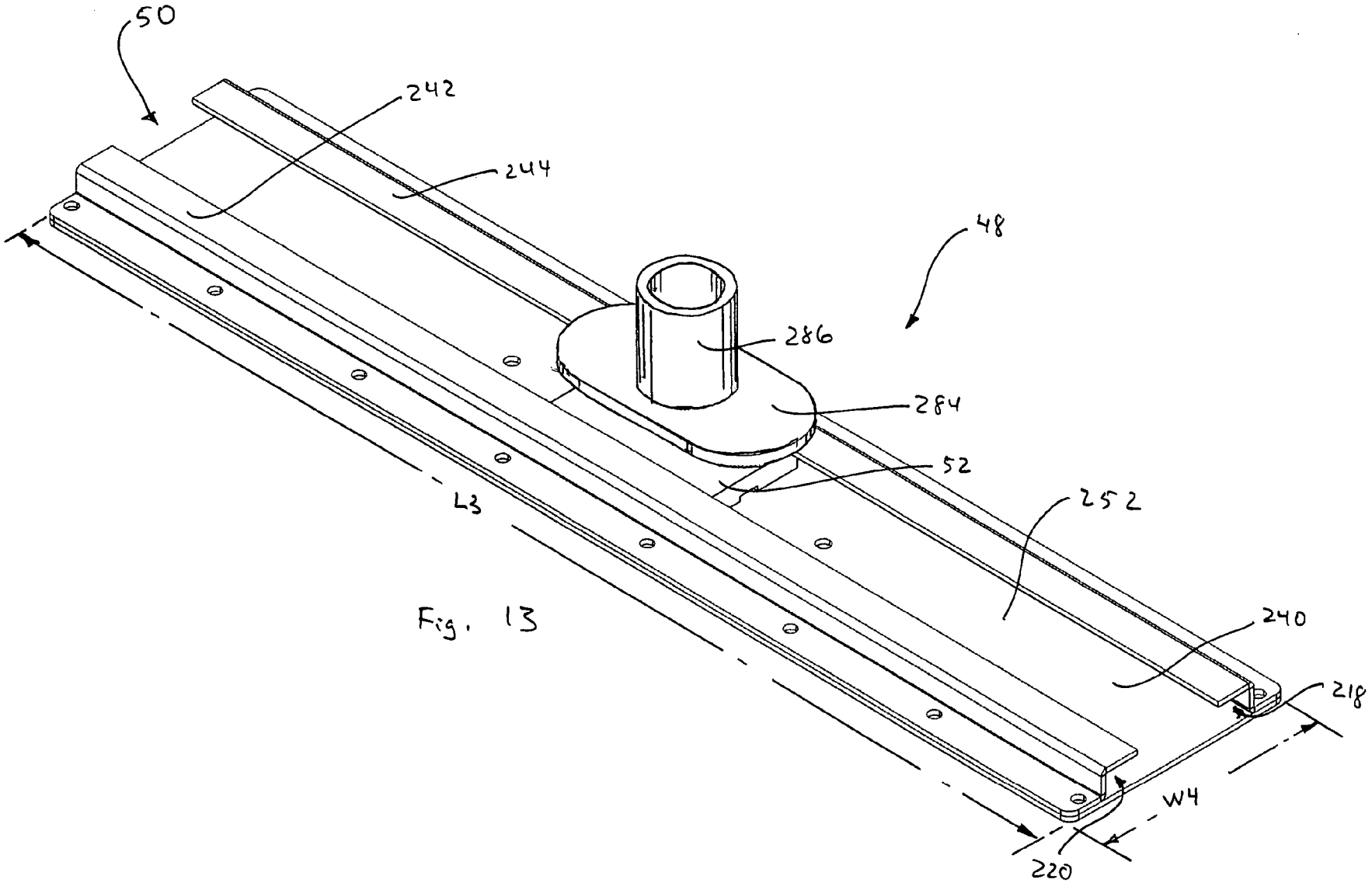
FIG. 13 is a perspective view of a carriage/track assembly according to one aspect of the present invention.
Figure 14A:
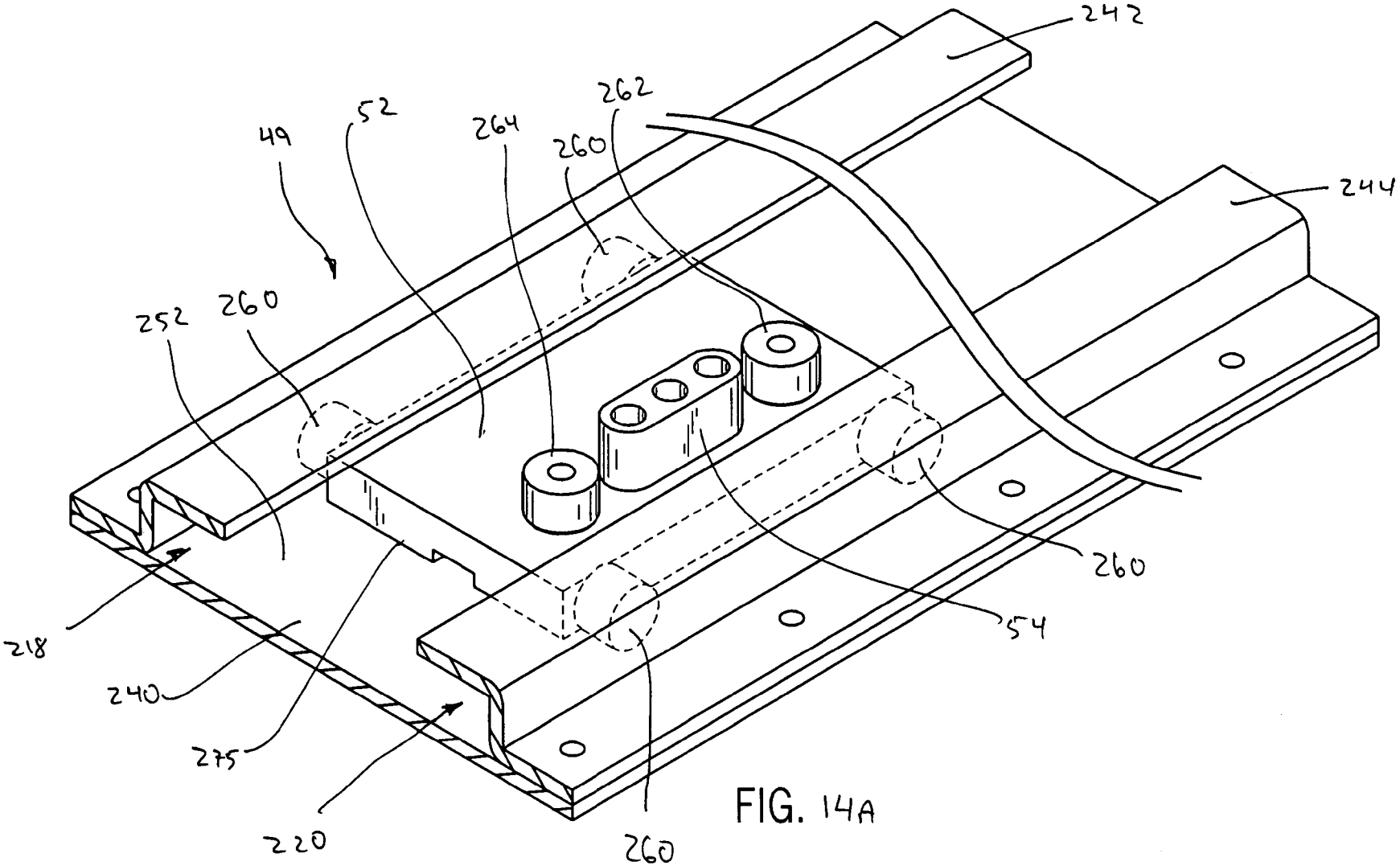
FIG. 14A is a perspective view of a carriage assembly and a bottom plate that form part of the undersurface assembly of FIG. 13.
Figure 14B:
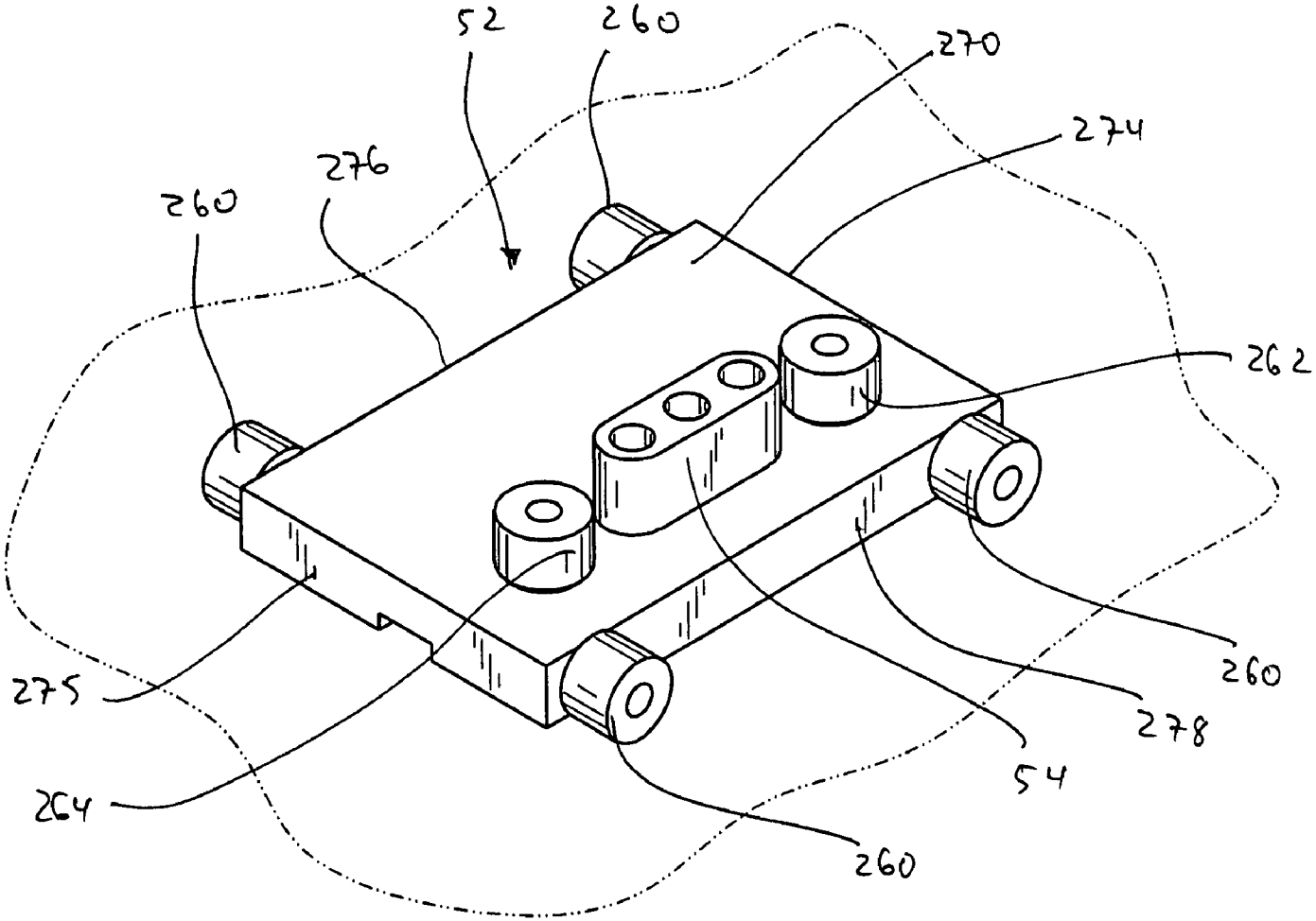
FIG. 14B is a perspective view of the carriage assembly of FIG. 14A.

Referring still to FIGS. 13 through 15, carriage/track assembly 48 includes an undersurface assembly 49 and an above surface assembly 282. The undersurface assembly includes a track assembly 50 and a carriage assembly 52. The above surface assembly includes a plate 284 and a cup member 286.

Track assembly 50 includes three components including a bottom plate 240 and first and second Z-members 242 and 244, respectively. Bottom plate 240 is a rigid, typically metal, rectilinear plate having a top surface 252 and an oppositely facing bottom surface 254. Plate 240 has length and width dimensions L3 and W4, respectively, such that plate 240 is receivable within the first recess tier 236 as illustrated best in FIG. 15.

Each of Z-members 242 and 244 is similarly constructed and operates in a similar fashion and therefore, in the interest of simplifying this explanation, only first Z-member 242 is described here. As its label implies, Z-member 242 has a generally Z-shaped cross-section best seen in FIGS. 14A and 15. To this end, member 242 includes first and second distal member 246 and 248, respectively as well as a central member 250. Distal members 246 and 248 are parallel to each other and have proximate ends linked to opposite ends of central member 250 where central member 250, in at least the illustrated embodiment, is perpendicular to each of members 246 and 248. Although not labeled, each of Z-members 242 and 244 has a length dimension similar to the length of bottom plate 240.

Referring once again to FIGS. 13 and 15, when track assembly 50 is assembled for operation, Z-member 242 is positioned with second distal member 248 and central member 250 received within second tier 238 and with first distal member 246 sandwiched between an adjacent portion of bottom plate 240 and a facing surface formed by first tier recess 236. Second Z-member 244 is similarly positioned on the opposite side of slot 60. When members 242 and 244 and bottom plate 240 are mounted within recess 56, the second distal members (e.g., 248) of Z-members 242 and 244 extend toward each other and surfaces of the second distal members (e.g., 248) that face the top surface 252 of bottom plate 240 and the top surface 252 form first and second race ways 218 and 220 along length L3 of plate 240. Plate 240 and Z-members 242 and 244 may be mounted within recess 56 in any manner including, but not limited to, screws (see 469 in FIG. 15) that extend up through plate 240 and the adjacent distal members 246 and 248 and are received within holes 471 (two holes 471 labeled in FIG. 12) formed in first tier recess 236. When Z-members 242 and 244 and bottom plate 240 are mounted within the recess, the portion of undersurface 234 that faces top surface 252 of bottom member 240 and facing top surface 252 form a track space passage 256 for receiving carriage assembly 52.

Importantly, when track assembly 50 is mounted within recess 56, in at least some embodiments of the present invention, substantially the entire or the entire track assembly 50 is received within recess 56 such that the undersurface 254 of bottom plate 240 is flush with or substantially flush with the undersurface 234 of top member 23 (see again FIG. 15). Thus, no components of the undersurface assembly extend below the undersurface 234 of top member 23 substantially that could impede placement of legs thereunder.

Referring still to FIGS. 13 through 15, carriage assembly 52 includes a base member 258, four horizontal rollers collectively identified by numeral 260, a mounting member or extension 54 and first and second vertical rollers 262 and 264, respectively. Base member 258 is a rigid metallic box-like member that includes a top surface 270, an oppositely facing bottom surface 272, first and second end surfaces 274 and 275, respectively, and first and second lateral surfaces 276 and 278, respectively. A first of the horizontal rollers 260 is mounted to first lateral surface 276 adjacent first end surface 274 for rotation about a horizontal access (not labeled) that is generally perpendicular to lateral surface 276 while a second of horizontal rollers 260 is mounted to first lateral surface 276 adjacent second end surface 275 for rotation about a second horizontal axis which is generally perpendicular to first lateral surface 276. Similarly, third and fourth horizontal rollers 260 are mounted for rotation about horizontal axis that are generally perpendicular to second lateral surface 278 proximate the first and second end surfaces 274 and 275, respectively. In at least some embodiments, the rollers 260 mounted adjacent first end surface 274 rotate about a first horizontal axis while the rollers 260 mounted adjacent second end surface 275 rotate about a second horizontal axis that is different than the first horizontal axis.

Each of rollers 260 has a radial dimension (not labeled) such that the roller fits with some leeway within one of the track assembly raceways 218, 220 (see again FIG. 13) as best illustrated in FIG. 15. When carriage assembly 52 is received within passage 256, rollers 260 suspend base member 258 between bottom plate 240 and the portion of lower surface 234 associated with second tier recess 238 such that top surface 270 faces the portion of undersurface 234 that forms recess 238. When carriage assembly 52 is positioned within track assembly 50, rollers 260 facilitate a rolling motion of base member 258 along the length of bottom member 240 as the rollers 260 rotate within raceways 218 and 220.

Mounting member or extension 60, in at least some embodiments, is integrally formed with base member 258 and, in any event, extends from and generally perpendicular to top surface 270. Mounting member 60 extends from a location on top surface 270 such that, when carriage assembly 52 is positioned for use, mounting member 60 extends up and through the slot 60 formed in top member 23. In the illustrated example, mounting member 54 has a generally over-shaped cross section that includes bolt or screw holes (not labeled) on an outwardly facing surface thereof that are usable to mount accessory components.

First vertical roller 262 is mounted to top surface 270 of base member 258 between mounting member 54 and the first end surface 274 for rotation about a first vertical axis while second vertical roller 264 is mounted to top surface 270 between mounting member 54 and second end surface 275 for rotation about a second vertical axis. Each of rollers 262 and 264 is dimensioned such that the roller is receivable within slot 60 and can bear there against to provide lateral stability to carriage assembly 52.

Referring once again to FIGS. 13 and 15, top assembly 282 includes a plate 284 that mounts via screws to the top surface of mounting member 54 above the top surface 22 of top member 23. Cup-shaped member 286 is mounted to a top surface of plate 284. In at least one embodiment, a support arm 290 best seen in FIGS. 1-4 and 6 is mounted to member 286 and may support one or more flat panel displays (e.g., 200, 202) for a sliding movement along the length of track assembly 50.

The exemplary arm 290 includes a lower arm member 501, a cross bar 503 and pivot pans 505 and 507. In at least some embodiments lower arm member 501 is mounted at a lower or first end to cup-shaped member 286 for rotation about a vertical axis (not labeled) and cross bar 503 is mounted at a central location along its length to the upper or second end of lower arm member 501 for rotation about a second vertical axis. Pans 505 and 507 are mounted for rotation about third and fourth vertical axis to the opposite ends of cross bar 503. Each of pans 505 and 507 is configured to allows the display screen mounted thereto to pivot about a horizontal axis. Thus, one or both screens 200 and 202 can be rotated about to face either into space 38 or out of space 38 or, for that matter, in any other desired direction for enhancing privacy or for sharing information.

In at least some embodiments undersurface assembly 49 may be dimensioned such that the entire track and carriage can fit within a very thin top member 23. For instance, it is contemplated that member 23 may be as thin as $\frac{3}{4}^{th}$ of an inch. Thicker members 23 are also contemplated.

D. Privacy Panel/Rail Assembly

Figure 16:
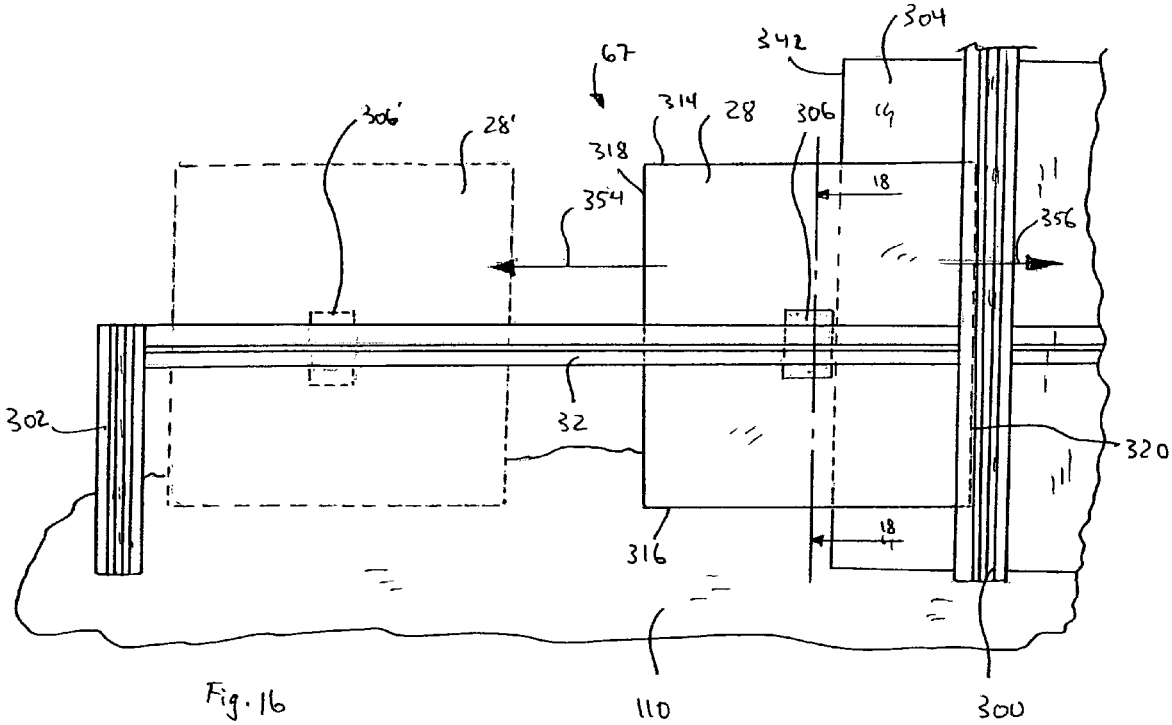
FIG. 16 is a front elevational view of the panel/rail assembly of FIG. 1.
Figure 17:
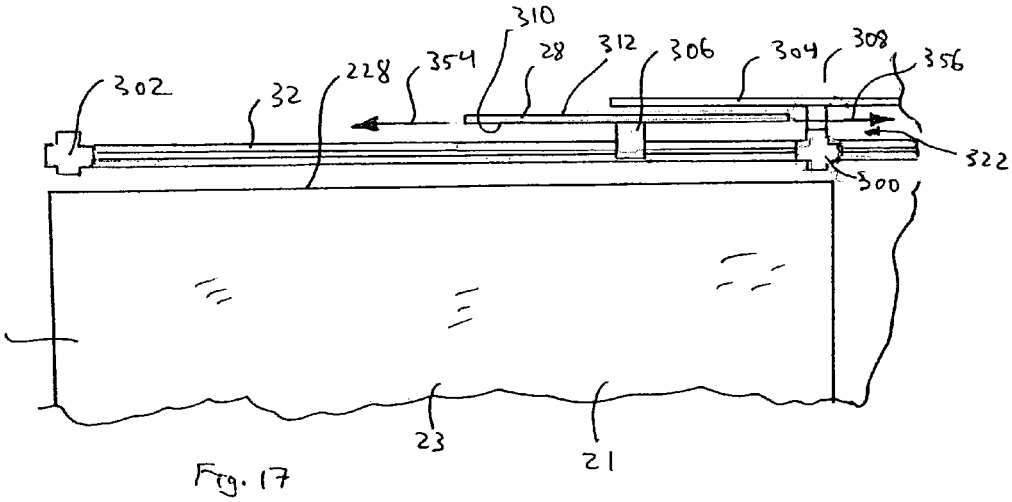
FIG. 17 is a top plan view of the system of FIG. 16 with a tabletop adjacent the rail.
Figure 18:
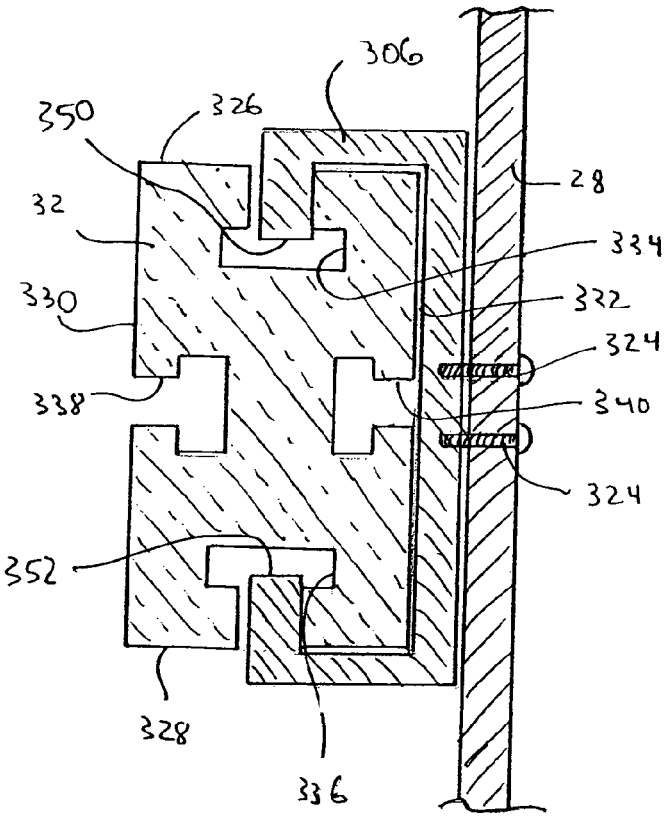
FIG. 18 is a cross sectional view taken along the line 18-18 in FIG. 16.
Figure 19:
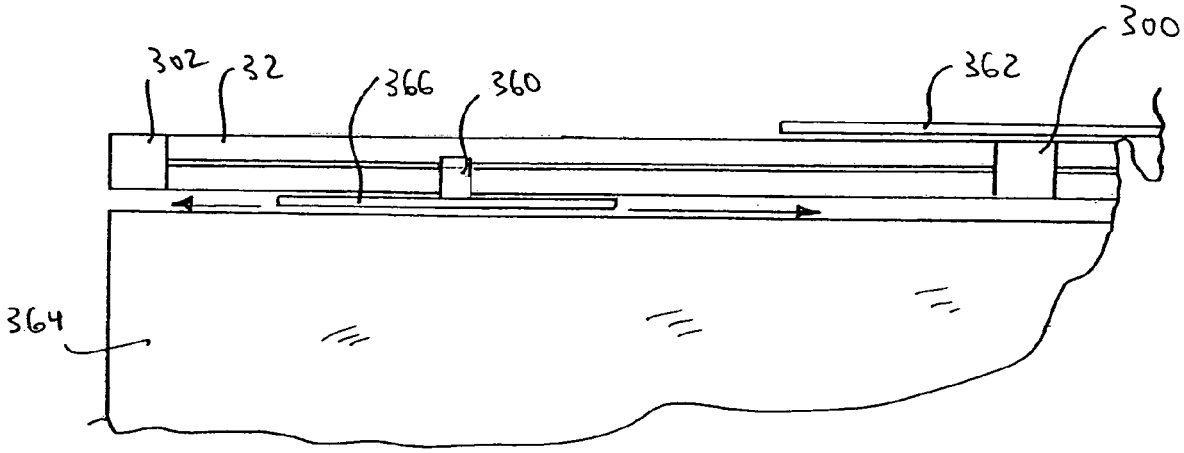
FIG. 19 is a top plan view similar to the view of FIG. 17, albeit illustrating another panel/rail assembly.

Referring now to FIGS. 1-3, 6 and also to FIGS. 16 through 18, exemplary screen/rail assembly 67 includes a plurality of vertically positioned posts 300, 301 and 302 (only posts 300 and 302 shown in FIGS. 16-18), horizontally supported rail member 32, a stationary panel or screen member 304, one or more stationary brackets 308 (see FIG. 17), first and second sliding privacy panels 28 and 30 (only panel 28 illustrated in FIGS. 16-18) and a separate sliding bracket 306 (only one illustrated in FIGS. 16 and 17). Posts 300 and 302 are secured to an ambient floor surface 110 and, in at least some cases, may be secured to a ceiling surface or structure as well (not illustrated). In other cases, the posts 300 and 302 may be freestanding and supported by other structure such as foot members or other rail members and post members mounted thereto. In the illustrated example, post 300 has a height that is relatively greater than post 302. For instance, post 300 may have height of 72 inches while post 302 has a height of 30 inches.

Rail member 32 is mounted at one end to approximately the top end of post 302 and at an opposite end at a similar vertical height to a central portion of post 300. In the illustrated embodiment, rail member 32 is positioned at a height that is approximately at a typical desktop height or slightly there below.

Referring specifically to FIG. 18, rail member 32 is a rigid extruded member that, in at least some cases, is formed of aluminum. The cross section of member 32 is generally rectilinear having a greater height dimension than width dimension and forms a top surface 326, a bottom surface 328 and first and second external lateral surfaces 330 and 332, respectively. Member 32 forms a separate T-slot in each one of the top, bottom and first and second lateral surfaces, 326, 328, 330 and 332, respectively. In FIG. 18, key slots are identified by numerals 334, 336, 338 and 340. As their labels imply, when rail member 32 is mounted to posts 300 and 302, top surface 326 faces upward, bottom surface 328 faces downward and lateral surfaces 330 and 332 are vertically juxtaposed and face in opposite directions.

Referring again to FIGS. 6 and 16-18, stationary panel 304 is mounted via the stationary brackets 308 to post 300 so as to be separated from post 300 and rail member 32 forming a gap or storage space 322 therebetween sufficiently wide for a slideable privacy panel 28 to be received within. As illustrated, stationary panel 304 has a lateral edge 342 that stops well short of post 302 such that, when desk assembly 21 is positioned adjacent rail member 32 as in FIG. 2, stationary screen 304 provides some privacy for a person using the portion of table top 23 adjacent post 300 but leaves the remaining portion of top 23 unblocked along rear edge 228.

Referring to FIGS. 16-20, slideable privacy panel 28, in at least one embodiment, is a rigid rectilinear member having a top edge 314, a bottom edge 316, a first lateral edge 318, a second lateral edge 320 and first and second oppositely facing surfaces 310 and 312, respectively. Panel 28 has dimensions selected to provide at least some level of privacy along rear edge 228 of table top 23 adjacent rail member 32 when panel 28 is in an in-use position. For example, in at least some cases, panel 28 will have a height dimension of approximately four feet between edges 314 and 316 and a width dimension of approximately three feet between lateral edges 318 and 320.

Figure 20:
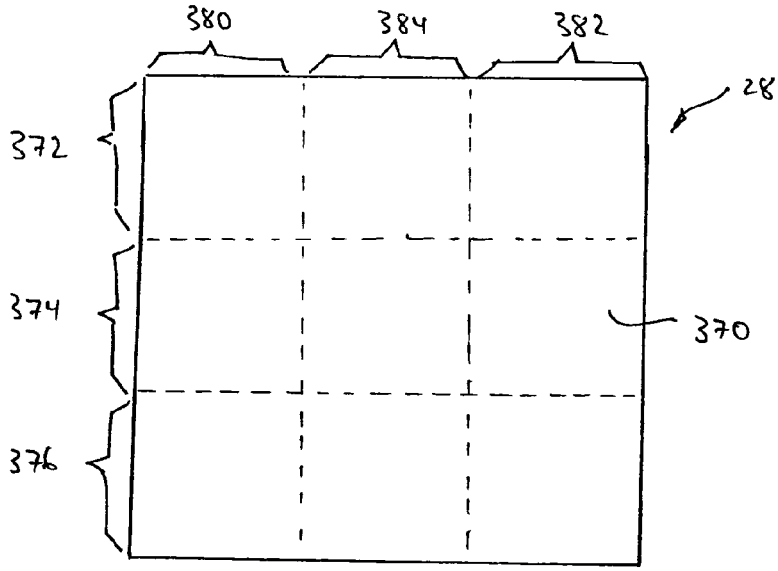
FIG. 20 is an elevational view of a privacy panel according to one aspect of the present invention.

Referring now to FIG. 20, an elevational view of an exemplary sliding panel 28 is illustrated where phantom lines have been included to divide one surface 370 of panel 28 into an upper one-third section 372, a mid one-third section 374 and a lower one-third section 376 as well as into a first lateral one-third section 380, a second lateral one-third section 382 and an intermediate one-third section 384 between the first and second lateral sections 380 and 382, respectively. In at least some cases, it is contemplated that a sliding bracket may be mounted within any one of the nine different portions of surface 370 illustrated in FIG. 20. For example, the bracket may be mounted within mid section 374 and within intermediate section 384 as illustrated in FIGS. 16 and 17. In the alternative, the bracket may be mounted within mid section 374 but within the first lateral section 380 and hence offset to one of the lateral edges of panel member 368. Similarly, the bracket may be mounted to mid section 374 but offset to the other lateral edge and within second lateral section 382 of panel member 368. Moreover, the bracket may be mounted within either the upper or lower (see FIGS. 1-3) sections 372 or 376, respectively and within any one of the sections 380, 382 or 384.

As best seen in FIG. 18, bracket 306 has a generally C-shaped cross section where distal ends 350 and 352 converge toward each other. Bracket 306 has dimensions such that the converging ends 350 and 352 are receivable within the T-slots 334 and 336 formed by top and bottom surfaces 326 and 328, respectively, of rail member 32. When bracket 306 is mounted to rail member 32 as illustrated in FIG. 18, panel 28 is generally vertically oriented. While bracket 306 is configured to be received by rail member 32, the dimensions of bracket 306 and member 32 are such that bracket 306 can slide along member 32 relatively easily as illustrated by arrows 354 and 356 in FIGS. 16 and 17.

Referring once again to FIGS. 16 and 17, in the illustrated embodiment, bracket 306 is mounted to the same side of rail member 32 as is stationary screen 304 and is dimensioned such that panel 28 is generally positioned between facing surfaces of stationary screen 304 and rail member 32. Thus, panel 28 is moveable along member 32 to be stored between stationary screen 304 and rail member 32 when a person using top member 23 does not require additional privacy and to be moved into an in-use position anywhere along the length of rail member 32 to provide additional privacy. In FIG. 16, screen 28' and associated bracket 306' show a screen and bracket in phantom in an in-use position proximate post 302.

E. Additional Embodiments

It should be appreciated that various concepts have been disclosed above and that there are several inventive aspects that may be employed together to provide additional synergistic functionality or that may be employed separately. To this end, exemplary additional configurations and concepts are described next that each are consistent with at least one aspect of the present invention.

The embodiment illustrated in FIGS. 16 through 18 is only an exemplary panel/rail configuration and other configurations of the panel/rail assembly 67 are contemplated. For example, referring to FIG. 19, in at least some embodiments, a sliding bracket 360 may extend from rail member 32 in a direction opposite a stationary screen 362 (i.e., toward a table top 364 as illustrated) such that a panel 366 mounted to bracket 360 is positioned on the table top side of rail member 32 for movement there along. In addition, in at least some cases, panel 366 may be used without a stationary screen 362.

It is also contemplated that, in at least some cases, two or more sliding stationary panels may be mounted to a single rail member 32 where the brackets that mount the sliding panels to the rail member 32 are offset from center and extend to different distances from the rail member such that the sliding panels can, in effect, stack together in a parallel relationship when stored.

Figure 21A:
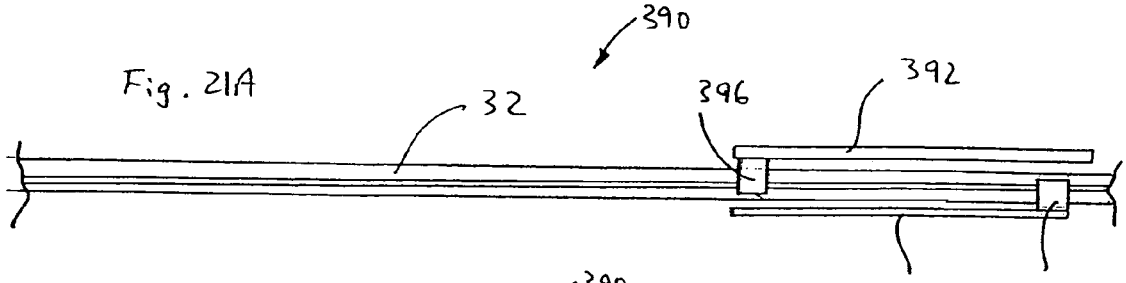
FIG. 21A and FIG. 21B show a third panel/rail assembly embodiment with panels in two different relative positions.
Figure 21B:
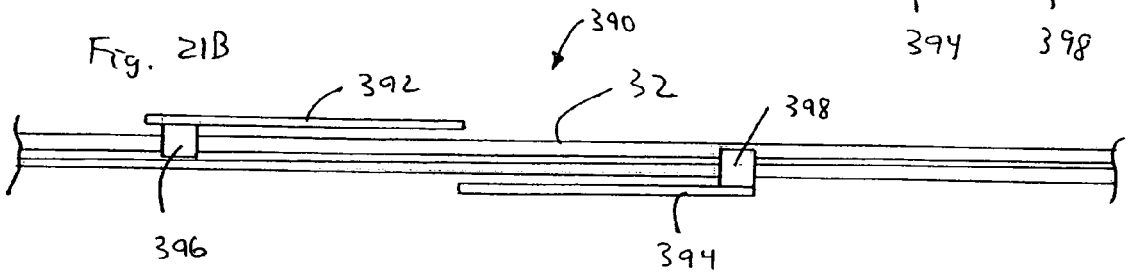

Referring now to FIGS. 21*a* and 21*b*, exemplary panel/rail configuration 390 illustrates first and second sliding privacy panels 392 and 394, respectively, that are mounted to a rail member 32 via first and second offset sliding brackets 396 and 398, respectively. In this embodiment, brackets 396 and 398 extend from rail member 32 in opposite directions such that panels 392 and 394 are positioned on opposite sides of rail member 32. When stored as in FIG. 21*a*, panels 392 and 394 stack up in parallel relationship. When privacy is desired, one or both of panels 392 and 394 may be slid along rail member 32 into any desired position, thereby allowing a user to increase or decrease privacy.

Figure 22A:
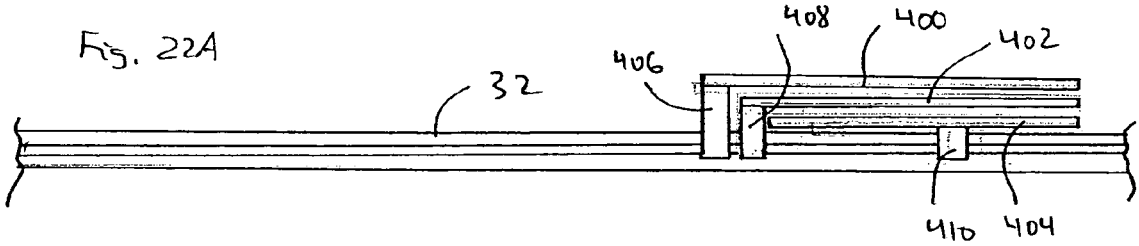
FIGS. 22A and 22B illustrate yet another panel/rail assembly including three panels where the panels are in two different relative juxtapositions.
Figure 22B:
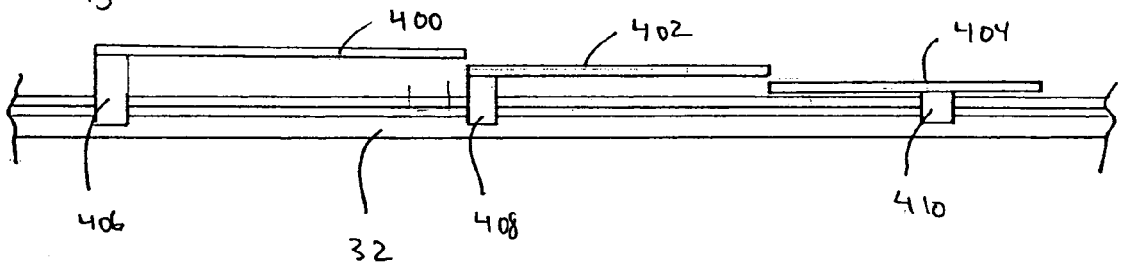

Referring now to FIGS. 22*a* and 22*b*, yet one additional embodiment is illustrated where three panels 400, 402 and 404 are mounted via three sliding brackets 406, 408 and 410 to the same side of rail member 32. Here, brackets 406 and 408 are offset toward one lateral edge of their respective panels 400 and 402, respectively, while bracket 410 is generally centered with respect to panel 404 mounted thereto. Once again, as shown in FIG. 22*a*, panels 400, 402 and 404 can be stacked in parallel relationship when stored and, when required for privacy, as shown in FIG. 22*b*, panels 400, 402 and 404 can be moved to a desired location along rail member 32.

Referring once again to FIG. 18, while not specifically illustrated, it is also contemplated that where more than one sliding panel is to be mounted to rail member 32, a different type of bracket may be employed to allow brackets that support panels on opposite sides of rail member 32 to slide past each other. For instance, a bracket may be constructed to be received within T-slots 334 and 340 for mounting a panel and another bracket may be constructed so as to be received within T-slots 338 and 336 for mounting a second panel. In this case, the different bracket arrangements would allow for parallel sliding screens.

Figure 30:
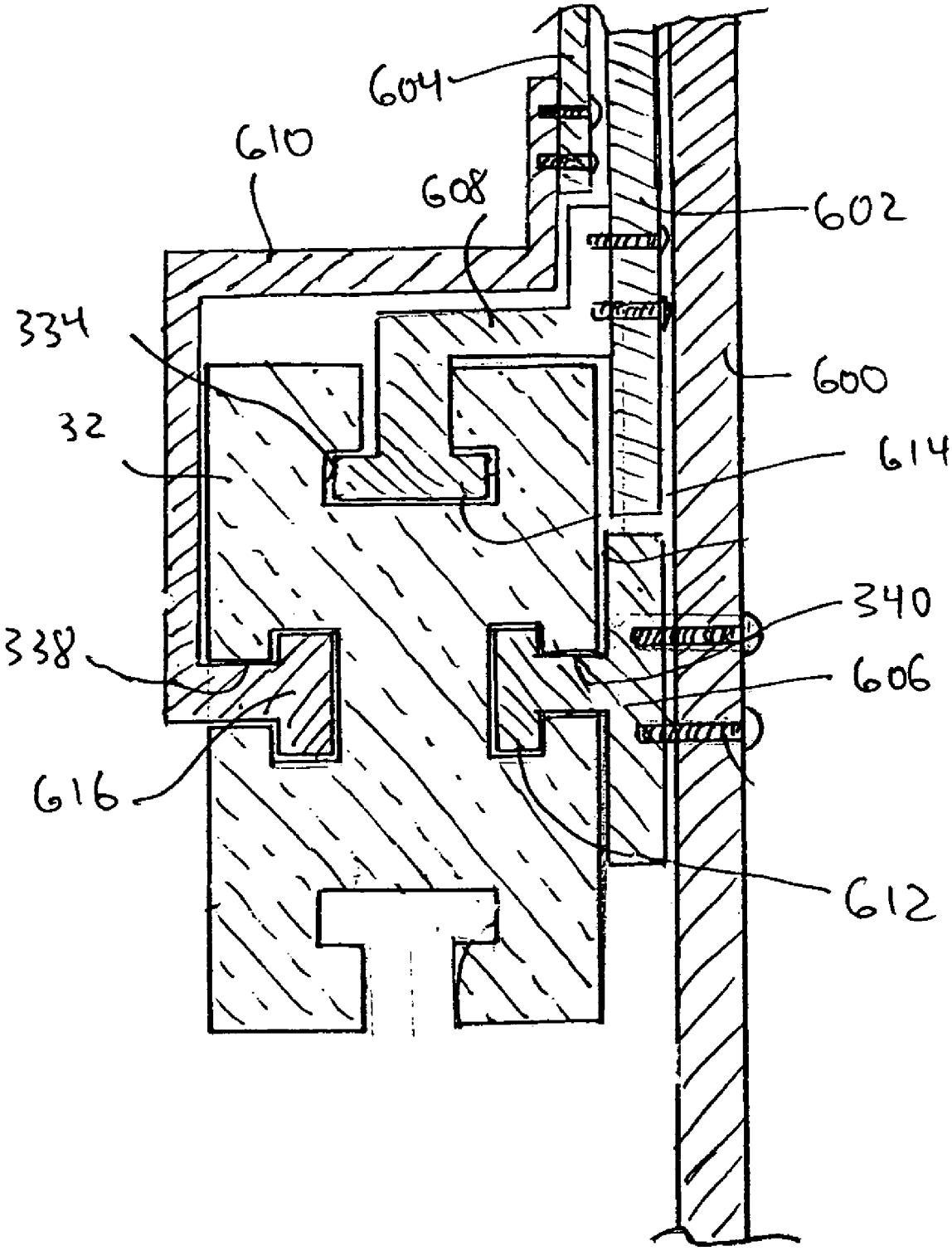
FIG. 30 is a view similar to the view of FIG. 18, albeit illustrating another panel-rail linkage configuration.

In addition, in at least some cases brackets are contemplated that include "T-shaped" end members where the T-shaped end member is receivable in one of the T-slots (e.g., 334) of rail member 32. Here, embodiments are contemplated where at least three slidable panel members may be configured so as to slide past each other along the rail 32. To this end, see FIG. 30 that shows three separate panels 600, 602 and 604 that are mounted via three separate brackets 606, 608 and 610 that have T-shaped end members 612, 614 and 616, respectively, to rail 32. Each end member 612, 614 and 616 is received within a separate one of the T-slots 340, 334 and 338, respectively. In FIG. 30, the brackets 606, 608 and 610 are configured so that the panels 600, 602 and 604 have proximate surfaces (i.e., the panels are relatively close to each other so that only small gaps exist between each two adjacent panels).

Referring once again to FIG. 16, while privacy panel 28 may simply be a rigid member where the surfaces thereof have no particular use or function, in some cases special surface treatments may be provided on one or both surfaces of panel 28 to facilitate a function. To this end, in at least some cases, it is contemplated that one or both of surfaces 310 and 312 may be a whiteboard surface, a chalkboard surface, a cork or material type surface for tacking purposes, etc.

Figure 29:
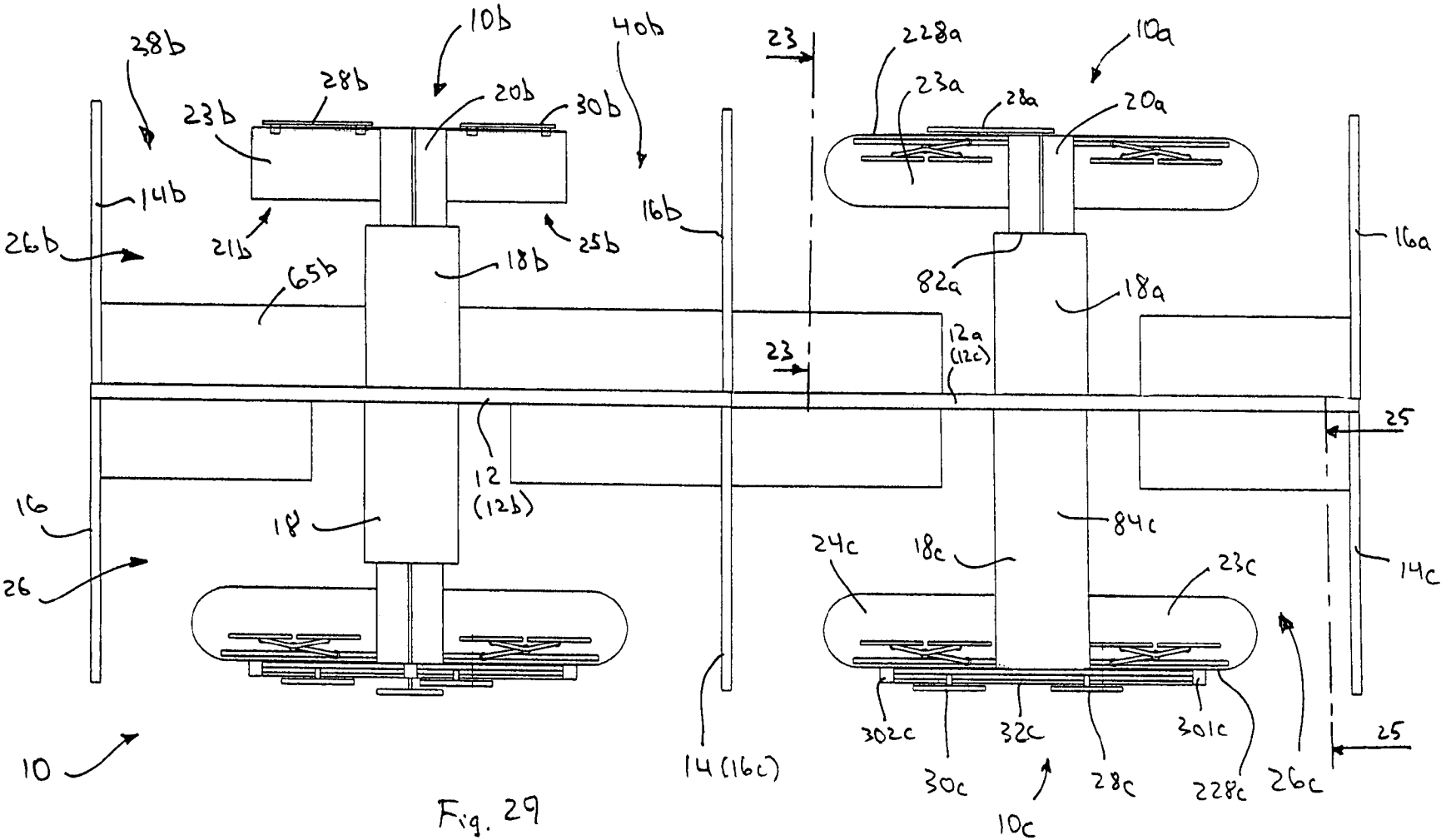
FIG. 29 is a top plan view of a partition system that forms four separate station spaces, each space configured to support a pair of people, where some of the partition walls are common to at least two of the station spaces and each space has a slightly different layout.

With respect to the general layout of multi-person space, referring to FIG. 29, it should be appreciated that at least some of the enclosure walls that form a two person station space can be used as common walls for separating one two person space from another. To this end, see that rear wall 12 separates two person space 26 from space 26*b* while side wall 14 separates space 26 from space 26C.

Figure 23:
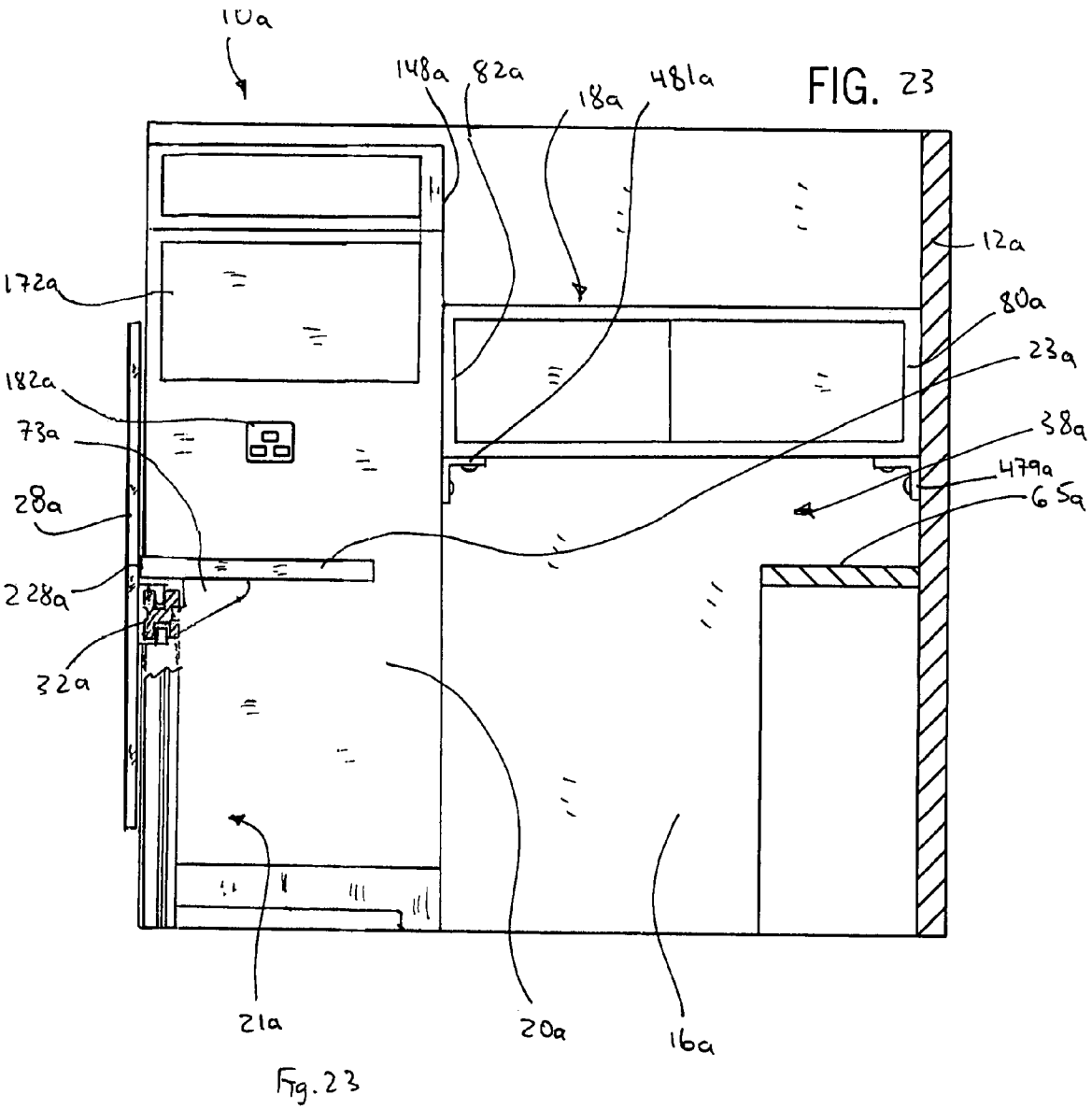
FIG. 23 is a view similar to FIG. 6, albeit of a second inventive configuration consistent with at least some aspects of the present invention and taken along the line 23-23 in FIG. 29.

With respect to two person space layouts, referring now to FIG. 23, a partial cross-sectional view similar to the view of FIG. 6 is provided which illustrates another exemplary station configuration according to at least some aspects of the present invention. In FIG. 23, components that are similar to components described above with respect to FIGS. 1-6 are identified by identical numbers followed by an "a". For example, the common table assembly in FIG. 23 is identified by numeral 18*a* while the dividing screen is identified by numeral 20*a*. Configuration 10*a* is also shown as one of the two person spaces in FIG. 29. There are several distinctions between configuration 10*a* and the configuration 10 described above. First, referring to FIGS. 6 and 29, in configuration 10*a*, common table assembly 18*a* does not include supporting partial wall 70 and instead, the facing surface of side wall 16*a* is seen through the opening underneath assembly 18*a*. Here, assembly 18*a* is still positioned and has dimensions such that the vision of a person of ordinary height sitting within subspace 38*a* will be blocked in the direction of the subspace on the other side of assembly 18*a*. End wall 82*a* of common table assembly 18*a* is mounted to and supported by an adjacent edge 148*a* of screen 20*a*. Similarly, end wall 80*a* is mounted to a surface of rear wall member 12*a*. Any means for mounting wall members 82*a* to edge 148*a* and wall 12*a* may be employed including, but not limited to, mechanical brackets. In FIG. 23 mechanical brackets 481*a* and 479*a* are illustrated.

Second, divider screen 20*a* is different in that a smaller functional panel 172*a* is provided within the midsection and a utility outlet panel 182*a* is provided at a higher level above a tabletop surface 23*a*. Third, in embodiment 10*a* the central post (e.g., 300 in the previous embodiments) has been eliminated and rail 32*a* has instead been mounted directly to divider screen 20*a*. Although not illustrated, the mount between rail 32*a* and screen 20*a* may be via a bracket or the like as should be understood by one of skill in the art.

Fourth, rail 32*a* is positioned below but adjacent rear edge 228*a* of table top member 23*a* such that when sliding privacy panel 28*a* is mounted to rail 32*a*, the surface of panel 28*a* facing into space 38*a* can be extremely close to rear edge 228*a*.

Fifth, table top member 23*a* is mounted via a bracket 500*a* to rail 32*a* such that independent leg supporting structure is not required for top member 23*a*.

Figure 24:
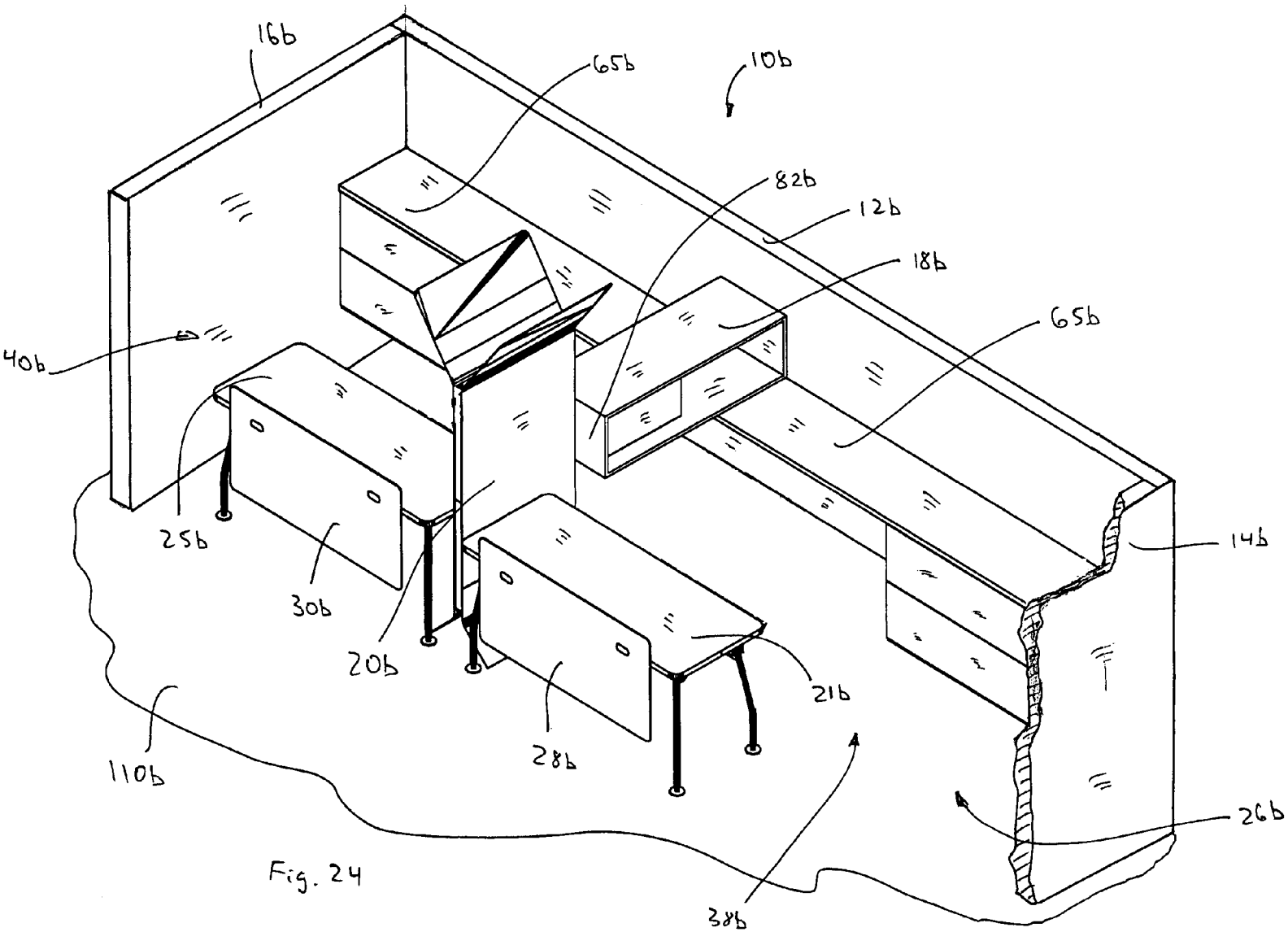
FIG. 24 is similar to FIG. 1, albeit illustrating third inventive configuration that is consistent with at least some aspects of the present invention.

Referring now to FIG. 24, yet one additional inventive configuration 10*b* is illustrated wherein components that are similar to the components described above are identified by the same number followed by a "b". Configuration 10*b* is also shown in FIG. 29 as one of several two person spaces. Configuration 10*b* is different than configuration 10 above in several respects. First, rear wall 12*b* and side walls 14*b* and 16*b* form station space 26*b* as described above and a credenza 65*b* extends along rear wall 12*b*. A common table assembly 18*b* and screen 20*b* (i.e., divider components) together divide the station space into adjacent subspaces 38*b* and 40*b* for two people. Second, no partial wall structure is provided below common table assembly 18*b*. Instead, the top surface formed by credenza 65*b* supports one end of assembly 18*b*. The end wall 82*b* opposite rear wall 12*b* is mounted to an edge of screen assembly 20*b* via a mechanical bracket or the like (not illustrated). Third, each of table assemblies 21*b* and 25*b* is essentially a separate and free standing table that does not need to be linked or secured to other components to maintain its in use position. Fourth, stationary privacy panels 28*b* and 30*b* are mounted directly to a rear edges (not labeled) of each of tables 21*b* and 25*b* to act as modesty panels and, at least in part, as privacy panels. Fifth, no monitor supporting assemblies (e.g., rotating arms, carriage and track assemblies, etc.) are provided in configuration 10*b*.

Figure 25:
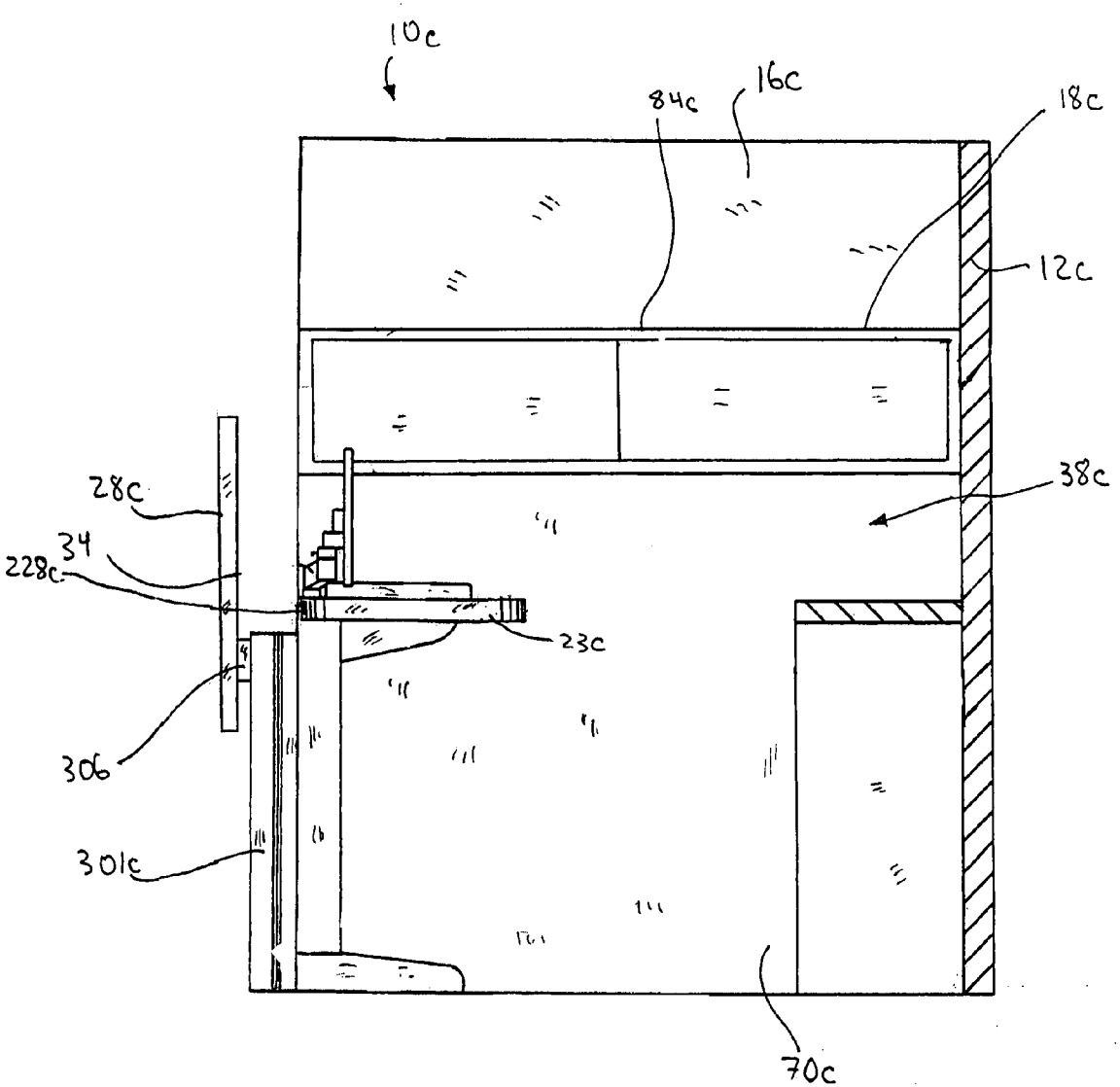
FIG. 25 is similar to FIG. 6, albeit illustrating a fourth partition wall configuration consistent with at least some aspects of the present invention and taken along the line 25-25 of FIG. 29.

Referring now to FIG. 25, yet one additional configuration 10*c* is illustrated wherein elements similar to the elements described above are identified by the same number followed by a "c". Configuration 10*c* is also shown as one of the two person spaces in FIG. 29. Configuration 10*c* is different than configuration 10 described above in several way. First, the central post 300 (see again FIG. 6) has been eliminated and rail member 32*c* is mounted between generally desk-height end posts 301*c* and 302*c*. Second, dividing screen 20 has been eliminated and table assembly 18*c* has been extended such that it extends from rear wall 12*c* to the front of the space defined by enclosure walls 12*c*, 14*c* and 16*c*. Here, lower wall assembly 70*c* extends along underneath the other common table assembly 18*c* components to provide support thereto. In this case, the top surface 84*c* of assembly 18*c* is larger and provides a greater surface area for collaborative activities. Nevertheless, because of the height of assembly 18*c*, a person sitting in subspace 38*c* cannot peer into the space on the other side of assembly 18*c* without standing. In this case, because the rail to which panel 28*c* is mounted extends between posts 301*c* and 302*c*, screen 28*c* can slide therealong from a position adjacent rear edge 228*c* of table top member 23*c* to another position adjacent the rear edge of top 24*c*. Panel 30*c* is similarly moveable.

While the heights of various system surfaces and structures are important to certain aspects of the present invention, other dimensions may be varied. For instance, two different sized privacy panels 28 are illustrated in FIGS. 3 and 16 and both are contemplated by the present invention. As another instance, common table 18 may have various length dimensions as can table top member 23.

Figure 26:
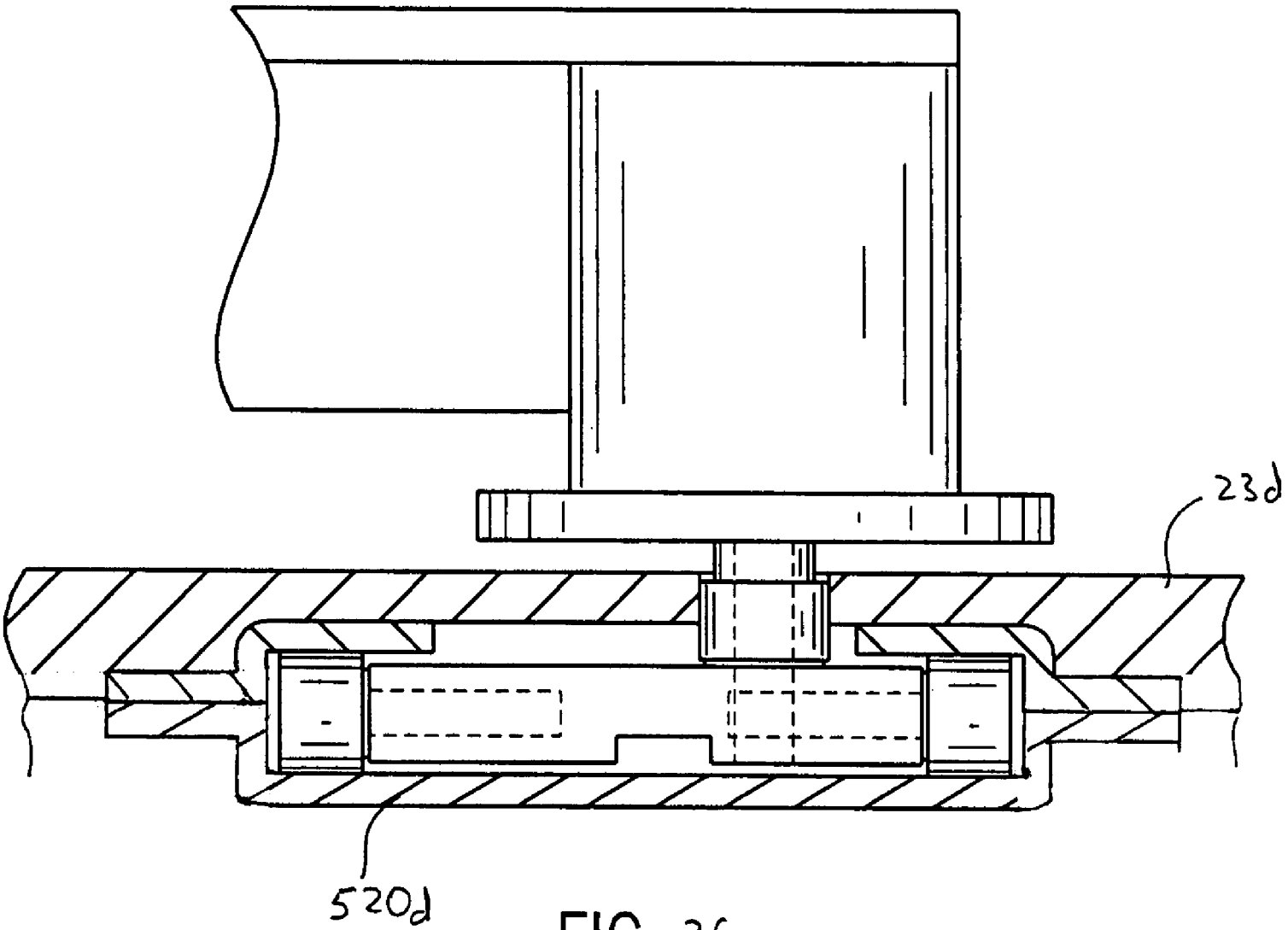
FIG. 26 is similar to FIG. 15, albeit illustrating a second carriage/track assembly consistent with at least some aspects of the present invention.
Figure 27:
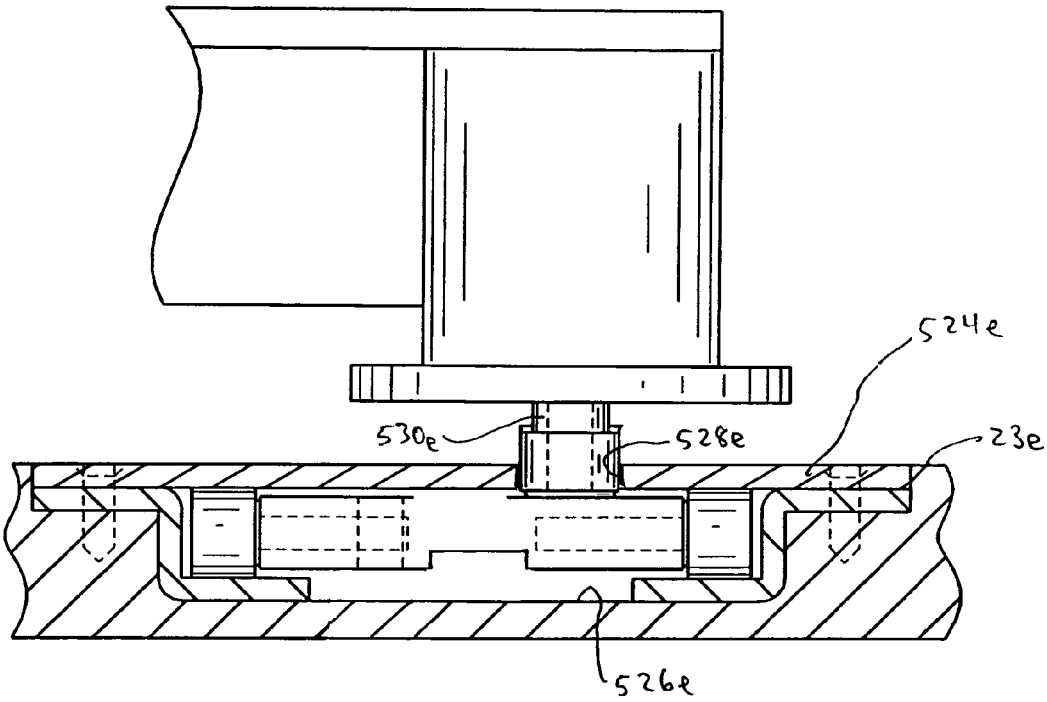
FIG. 27 is similar to FIG. 15, albeit illustrating a third carriage/track assembly consistent with at least some aspects of the present invention.

With respect to the carriage/track and table configurations, while the carriage/track assembly described above is dimensioned so as to be completely disposed within a recess in the undersurface of a table top, in at least some cases it is contemplated that the assembly may extend below the undersurface at least somewhat. To this end, see FIG. 26 where the lower plate (i.e., 240 above) has been replaced by a contoured plate 520*d* but the other components remain similar. This embodiment is particularly useful where the table top member (see 23*d* in FIG. 26) has a relatively minimal thickness Moreover, while the recess for the carriage/track assembly is disclosed above as being formed in the undersurface of the table top, it is contemplated that the recess may be formed in the top surface or even into an edge surface in some cases. When the recess is in the top surface, a plate that forms a slot may be configured to close the top surface recess except for the slot. In this regard, see FIG. 27 that shows a plate 524*e* received with in top surface recess 526*e* in a table top 23*e* that forms a slot 528*e* for mounting member 530*e*.

Figure 28:
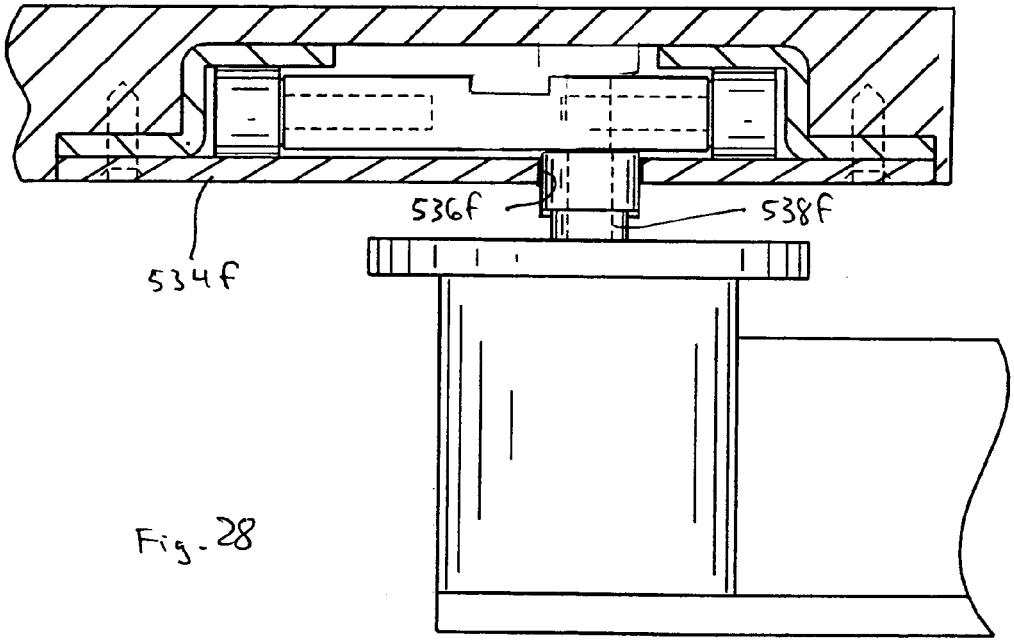
FIG. 28 is similar to FIG. 15, albeit illustrating one additional carriage/track assembly consistent with at least some aspects of the present invention.

Furthermore, when the recess is formed in the undersurface as in FIGS. 10 through 12, a slot may be formed in the plate member that covers the recess and the mounting member may extend downward through the slot instead of upward. To this end, see FIG. 28 that shows plate 534*f* that forms a slot 536*f* where mounting member 538*f* extends downward through the slot 536*f*.

With respect to the space divider screen 20 in FIGS. 7-9, while the exterior members 130 and 132 are described above as being aluminum, it should be appreciated that other sufficiently strong and structurally sound materials are contemplated such as other metals, woods, laminated materials, extruded plastic materials, and so on. In addition, in at least some cases, the external members 130 and 132 may have general shapes other than rectilinear such as an hour glass shape, an oval shape, a shape having curved edges, a shape having a contoured top edge for either functional or stylistic purposes, etc.

Figure 31:
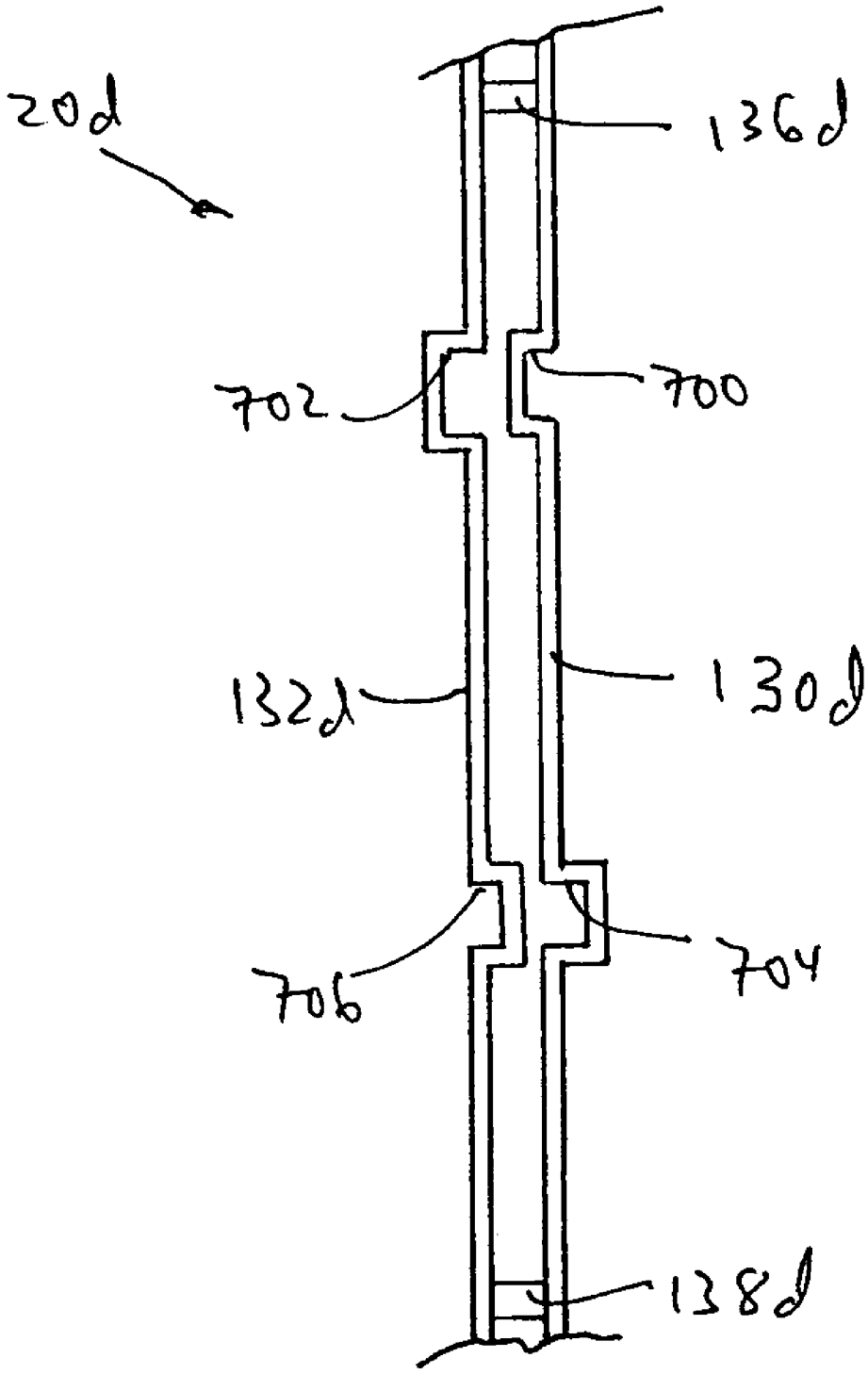
FIG. 31 is a side elevational view of a portion of a screen divider according to one inventive aspect.

Moreover, screens 20 are contemplated that do not include outwardly flaring upper structure but that simply terminate vertically. In at least some cases screens 20 may have height dimensions such that they can reside below table assemblies like assembly 18 to close off space between two subspaces or to provide support for a table top member thereabove. Furthermore, at least some screens may include external members that have additional contour such as ribs or the like for style and/or functional purposes (e.g., to help position internal members for mounting, etc.). To this end see FIG. 31 where a portion of a screen 20*d* is illustrated including external members 130*d* and 132*d* that each include contours (e.g., 700, 702, 704, 706). Internal members 136*d* and 138*d* are akin to the similarly numbered members in FIG. 8.

While the invention may be susceptible to various modifications and alternative forms, specific embodiments have been described herein by way of example. Nevertheless, it should be appreciated that the inventive aspects described herein are not intended to be limited to the particular embodiments described above and the invention is intended to cover all modifications, equivalents and alternatives falling within the spirit and scope of the invention as defined by the following claims.

What is claimed is:

1. A work space assembly for use by a pair of people where the pair of people include first and second persons, the system providing each of the first and second persons with a private space and also providing a shared space to be shared by the pair of people during collaboration, the assembly comprising:

an enclosure wall supported by a floor surface and having first and second distal wall edges that are within an opening plane, the enclosure wall forming a station space including one open side between the distal edges, a rear portion of the enclosure wall spaced a station depth from the opening plane, the enclosure wall having an enclosure height of at least forty-eight inches above the floor surface;

a table top having a table top length dimension between first and second oppositely facing ends that is less than the station depth dimension, the top having a table height of between forty and fifty-two inches above the floor surface; and a space divider screen having generally oppositely facing first and second edges, first and second side surfaces and where a top edge of the divider screen is at least sixty inches above the floor surface;

wherein, the table top is positioned with the table top length dimension substantially perpendicular to the rear portion of the enclosure wall and extending between the rear portion and the opening plane and the first edge of the space divider screen is positioned at the second end of the table top with the space divider screen extending there from substantially parallel to the table top length dimension such that the top and the screen partition the station space into first and second subspaces.

2. The assembly of claim 1 wherein the table top is disposed between the rear portion of the enclosure wall and the divider screen and wherein the first side of the divider screen faces in the general direction of the first edge of the enclosure wall.

3. The assembly of claim 2 wherein the second edge of the divider screen is disposed at least proximate the opening plane such that a first opening is formed between the second edge of the divider screen and the first edge of the enclosure wall and a second opening is formed between the second edge of the divider screen and the second edge of the enclosure wall.

4. The assembly of claim 3 wherein the first and second openings have first and second opening dimensions, the first and second opening dimensions are substantially similar and wherein the first and second subspaces are similarly sized.

5. The assembly of claim 3 further including a desk top having a front edge, a rear edge, first and second lateral edges and a desk height of between twenty-four and thirty-two inches and wherein the first lateral edge of the desk top is positioned adjacent the first side of the divider screen and the rear edge of the desk top is generally parallel to an adjacent portion of the opening plane such that the desk top extends toward the first edge of the enclosure wall.

6. The assembly of claim 5 wherein an entry space is formed between the second edge of the desk top and the first edge of the enclosure wall for accessing the first subspace.

7. The assembly of claim 6 wherein the second edge of the desk top is curved.

8. The assembly of claim 6 further including a video display screen positioned on the desk top proximate the rear edge of the desk top for use by a person sitting proximate the front edge of the desk top and within the first subspace.

9. The assembly of claim 8 wherein the display screen is a flat panel display screen.

10. The assembly of claim 9 wherein the display screen is mounted for sliding movement along at least a portion of the rear edge of the desk top.

11. The assembly of claim 6 wherein the desk top is a first desk top and the assembly further includes a second desk top having a front edge, a rear edge, first and second lateral edges and a desk height of between twenty-four and thirty-two inches above the floor surface and wherein the first lateral edge of the second desk top is positioned adjacent the second side of the divider screen and the rear edge of the second desk top is generally parallel to an adjacent portion of the opening plane such that the second desk top extends toward the second edge of the enclosure wall.

12. The assembly of claim 11 wherein the entry space is a first entry space and a second entry space is formed between the second edge of the second desk top and the second edge of the enclosure wall for accessing the second subspace.

13. The assembly of claim 6 further including a privacy screen having a top edge and first and second lateral edges, the privacy screen at least positionable adjacent a portion of the rear edge of the desk top with at least a portion of the privacy screen residing at a height above the desk top height.

14. The assembly of claim 13 wherein the desk top has a desk top length dimension between the first and second lateral edges and wherein a privacy screen width dimension between the first and second lateral edges of the privacy screen is less than the desk top length dimension.

15. The assembly of claim 14 wherein the privacy screen width dimension is between one fourth and three-fourths of the desk top length dimension.

16. The assembly of claim 14 wherein the privacy screen is moveable along the length of the rear edge of the desk top so as to change the relative juxtaposition of the privacy screen and the desk top.

17. The assembly of claim 1 wherein the table top includes first and second lateral edges and has a maximum table top width dimension between the first and second lateral edges of between fifteen and thirty inches above the floor surface.

18. The assembly of claim 17 wherein the table top width dimension is between twenty and twenty-six inches above the floor surface.

19. The assembly of claim 1 wherein the enclosure wall includes a planar rear wall member and first and second planar side wall members, the first and second side wall members extending perpendicular to and to the same side of the rear wall member from spaced apart locations along the rear wall member, respectively, such that the station space is formed between the first and second side wall members.

20. The assembly of claim 1 further including a substantially horizontal credenza surface having a height of between twenty-four and thirty-two inches above the floor surface, the credenza surface positioned along the rear portion of the enclosure wall.

21. The assembly of claim 1 wherein the table top includes a top surface that is accessible from within each of the first and second subspaces.

22. The assembly of claim 1 wherein the table top forms a top surface that is shared between the first and second subspaces.

23. The assembly of claim 1 wherein a support structure extends downward from an undersurface of the table top to the floor surface there below to support the top above the floor surface.

24. The assembly of claim 23 wherein the support structure includes at least one shelf member below the table top.

25. The assembly of claim 24 wherein the support structure further includes a divider wall below the shelf member and wherein the top of the divider wall has a height of between thirty-two and eight-eight inches above the floor surface.

26. The assembly of claim 25 wherein the space below the shelf member and adjacent the divider wall is unobstructed.

27. The assembly of claim 24 wherein the table top includes first and second lateral edges that extend the distance of the table top length and wherein the space between the shelf member and the table top is open below each lateral edge of the table top.

28. A work space assembly for use by a pair of people where the pair of people include first and second persons, the system providing each of the first and second persons with a private space and also providing a shared space to be shared by the pair of people during collaboration, the assembly comprising:

a substantially planar rear wall member supported above a floor surface and having a first height of at least forty-eight inches above the floor surface;

first and second substantially planar side wall members extending perpendicular to and to the same side of the rear wall member from spaced apart locations along the rear wall member such that a station space is formed between the first and second side wall members and adjacent the rear wall member;

a table top having a table top length dimension between first and second oppositely facing ends, the top having a table height of between forty and fifty-two inches above the floor surface; and a space divider screen having generally oppositely facing first and second edges, first and second side surfaces and a top edge that is at least sixty inches above the floor surface;

wherein, the table top is positioned with the table top length dimension substantially perpendicular to the rear wall member and extending between and substantially parallel to the first and second side wall members and the first edge of the space divider screen is positioned at the second end of the table top with the space divider screen extending there from substantially parallel to the table top length dimension such that the top and the screen partition the station space into first and second subspaces.

29. The assembly of claim 28 wherein the first end of the table top is adjacent the rear wall member.

30. The assembly of claim 29 further including a desk top having a front edge, a rear edge, first and second lateral edges and a desk height of between twenty-four and thirty-two inches and wherein the first lateral edge of the desk top is positioned adjacent the first side of the divider screen and the rear edge of the desk top is generally perpendicular to the divider screen such that the desk top extends toward the first side wall and a first entry space is formed between the second edge of the desk top and the first side wall for accessing the first subspace.

31. The assembly of claim 30 wherein the desk top is a first desk top and the assembly further includes a second desk top having a front edge, a rear edge, first and second lateral edges and a desk height of between twenty-four and thirty-two inches and wherein the first lateral edge of the second desk top is positioned adjacent the second side of the divider screen and the rear edge of the second desk top is generally perpendicular to the divider screen such that the second desk top extends toward the second side wall and a second entry space is formed between the second edge of the second desk top and the second side wall for accessing the second subspace.

32. The assembly of claim 30 further including a privacy screen having first and second lateral edges, the privacy screen at least positionable adjacent a portion of the rear edge of the desk top with at least a portion of the privacy screen residing at a height above the desk top height wherein the desk top has a desk top length dimension between the first and second lateral edges and wherein a privacy screen width dimension between the first and second lateral edges of the privacy screen is less than the desk top length dimension.

33. The assembly of claim 32 wherein the privacy screen is moveable along the length of the rear edge of the desk top so as to change the relative juxtaposition of the privacy screen and the desk top.

34. A work space assembly comprising:

a substantially planar rear wall member supported above a floor surface and having a first height of at least forty-eight inches above the floor surface;

first and second substantially planar side wall members extending perpendicular to and to the same side of the rear wall member from spaced apart locations along the rear wall member such that a station space is formed between the first and second side wall members and adjacent the rear wall member;

a table top having a table top length dimension between first and second oppositely facing ends, the top having a table height of between forty and fifty-two inches above the floor surface; and a space divider screen having generally oppositely facing first and second edges, first and second side surfaces and a top edge that is at least sixty inches;

first and second desk tops, each of the first and second desk tops having a front edge, a rear edge, first and second lateral edges, a desk height of between twenty-four and thirty-two inches above the floor surface and a desk top length dimension between the first and second lateral side edges;

wherein, the table top is positioned with the first end thereof adjacent and the table top length dimension substantially perpendicular to the rear wall member, the first edge of the space divider screen is positioned at the second end of the table top with the space divider screen extending there from substantially parallel to the table top length dimension such that the top and the screen partition the station space into first and second subspaces, the first desk top positioned with the first lateral edge of the first desk top adjacent and the first desk top length dimension substantially perpendicular to the first side of the divider screen such that the first desk top extends toward the first side wall and a first entry space is formed between the second edge of the first desk top and the first side wall for accessing the first subspace and the second desk top positioned with the first lateral edge of the second desk top adjacent and the second desk top length dimension substantially perpendicular to the second side of the divider screen such that the second desk top extends toward the second side wall and a second entry space is formed between the second edge of the second desk top and the second side wall for accessing the second subspace.

35. The assembly of claim 28 wherein the table top forms a top surface that is shared between the first and second subspaces.

36. The assembly of claim 34 wherein the table top includes a top surface that is accessible from within each of the first and second subspaces.

37. The assembly of claim 36 wherein each of the desk tops has a height of between twenty-four and thirty-two inches above the floor surface.

38. The assembly of claim 36 further including a privacy screen having first and second lateral edges, the privacy screen at least positionable adjacent a portion of the rear edge of the first desk top with at least a portion of the privacy screen residing at a height above the desk top height wherein the first desk top has a desk top length dimension between the first and second lateral edges and wherein a privacy screen width dimension between the first and second lateral edges of the privacy screen is less than the desk top length dimension.

39. The assembly of claim 38 wherein the privacy screen is moveable along the length of the rear edge of the desk top so as to change the relative juxtaposition of the privacy screen and the desk top.

40. The assembly of claim 28 wherein the table top includes a top surface that is accessible from within each of the first and second subspaces.

41. The assembly of claim 34 wherein the table top forms a top surface that is shared between the first and second subspaces.

* * * * *